US009928824B2

(12) United States Patent
Barath et al.

(10) Patent No.: US 9,928,824 B2
(45) Date of Patent: Mar. 27, 2018

(54) APPARATUS, SYSTEM AND METHOD OF CONTROLLING NOISE WITHIN A NOISE-CONTROLLED VOLUME

(71) Applicant: Silentium Ltd., Ness Ziona (IL)

(72) Inventors: Jossef Barath, Herzliya (IL); Daniel Cherkassky, Mazor (IL); Yaron Karo, Hafetz Haim (IL)

(73) Assignee: SILENTIUM LTD., Ness Ziona (IL)

( * ) Notice: Subject to any disclaimer, the term of this patent is extended or adjusted under 35 U.S.C. 154(b) by 0 days.

(21) Appl. No.: 14/980,175

(22) Filed: Dec. 28, 2015

(65) Prior Publication Data

US 2016/0111078 A1 Apr. 21, 2016

Related U.S. Application Data

(63) Continuation-in-part of application No. 13/468,170, filed on May 10, 2012, now Pat. No. 9,431,001.
(Continued)

(51) Int. Cl.
*G10K 11/178* (2006.01)

(52) U.S. Cl.
CPC .... *G10K 11/1786* (2013.01); *G10K 2210/118* (2013.01); *G10K 2210/1282* (2013.01);
(Continued)

(58) Field of Classification Search
CPC ..... G10K 11/1786; G10K 2210/108; G10K 2210/1081; G10K 2210/118;
(Continued)

(56) References Cited

U.S. PATENT DOCUMENTS 2,043,416 A 6/1936 Lueg
2,091,774 A 8/1937 Weiland
(Continued)

FOREIGN PATENT DOCUMENTS

EP 0615224 9/1994
EP 0759606 2/1997
(Continued)

OTHER PUBLICATIONS

English machine translation of JP H08-296335 (Tamura et al., Active Soundproof Hood Device, published Nov. 1996).*
(Continued)

*Primary Examiner* — Mark Fischer
(74) *Attorney, Agent, or Firm* — Shichrur & Co.

(57) ABSTRACT

A noise control system may be configured to process one or more first noise inputs from one or more first acoustic sensors, the one or more first noise inputs representing external noise sensed at one or more respective noise sensing locations on an outer surface of a sheltering structure; to process one or more second noise inputs from one or more second acoustic sensors, the one or more second noise inputs representing residual noise at one or more respective residual noise sensing locations on an inner surface of the sheltering structure; to determine a noise control pattern based at least on the one or more first noise inputs and the one or more second noise inputs; and to generate one or more control signals to control acoustic signals generated by one or more acoustic transducers based on the noise control pattern.

26 Claims, 13 Drawing Sheets

Related U.S. Application Data

(60) Provisional application No. 62/097,086, filed on Dec. 28, 2014, provisional application No. 61/484,722, filed on May 11, 2011.

(52) U.S. Cl.
CPC ..... *G10K 2210/3014* (2013.01); *G10K 2210/30231* (2013.01); *G10K 2210/3221* (2013.01); *G10K 2210/505* (2013.01)

(58) Field of Classification Search
CPC ... G10K 2210/1282; G10K 2210/3014; G10K 2210/30231; G10K 2210/3026; G10K 2210/3027; G10K 2210/3046; G10K 2210/3221; G10K 21/02082; G10K 2210/082
See application file for complete search history.

(56) References Cited

U.S. PATENT DOCUMENTS

| | | | |
|---|---|---|---|
| 4,025,724 A | 5/1977 | Davidson, Jr. et al. | |
| 4,665,549 A | 5/1987 | Eriksson et al. | |
| 4,965,832 A | 10/1990 | Edwards et al. | |
| 5,117,401 A | 5/1992 | Feintuch | |
| 5,182,774 A | 1/1993 | Bourk | |
| 5,216,722 A | 6/1993 | Popovich | |
| 5,253,486 A | 10/1993 | Sugahara et al. | |
| 5,271,062 A | 12/1993 | Sugita et al. | |
| 5,325,437 A | 6/1994 | Doi et al. | |
| 5,343,713 A | 9/1994 | Okabe et al. | |
| 5,347,586 A | 9/1994 | Hill et al. | |
| 5,365,594 A | 11/1994 | Ross et al. | |
| 5,377,275 A | 12/1994 | Suzuki | |
| 5,410,607 A | 4/1995 | Mason | |
| 5,471,537 A | 11/1995 | Castwall | |
| 5,475,731 A | 12/1995 | Rasmusson | |
| 5,475,761 A | 12/1995 | Eatwell | |
| 5,478,199 A | 12/1995 | Gliebe | |
| 5,511,127 A | 4/1996 | Warnaka | |
| 5,519,637 A | 5/1996 | Mathur | |
| 5,553,154 A | 9/1996 | Tamamura et al. | |
| 5,568,557 A | 10/1996 | Ross et al. | |
| 5,602,926 A | 2/1997 | Ohashi et al. | |
| 5,602,927 A | 2/1997 | Tamamura et al. | |
| 5,606,622 A | 2/1997 | Christenson | |
| 5,613,009 A | 3/1997 | Miyazaki et al. | |
| 5,618,010 A | 4/1997 | Pla et al. | |
| 5,627,896 A | 5/1997 | Southward et al. | |
| 5,636,286 A | 6/1997 | Makabe et al. | |
| 5,680,393 A | 10/1997 | Bourmeyster et al. | |
| 5,680,450 A | 10/1997 | Dent et al. | |
| 5,694,476 A | 12/1997 | Klippel | |
| 5,745,731 A | 4/1998 | Kim et al. | |
| 5,748,748 A | 5/1998 | Fischer et al. | |
| 5,748,749 A | 5/1998 | Miller et al. | |
| 5,768,398 A | 6/1998 | Janse et al. | |
| 5,796,819 A * | 8/1998 | Romesburg ..... | H04M 9/082 370/291 |
| 5,812,973 A | 9/1998 | Wang | |
| 5,937,070 A | 8/1999 | Todter et al. | |
| 5,978,489 A | 11/1999 | Wan | |
| 6,005,952 A | 12/1999 | Klippel | |
| 6,078,671 A | 6/2000 | Kawanishi et al. | |
| 6,084,971 A | 7/2000 | McLean | |
| 6,160,392 A | 12/2000 | Shin | |
| 6,160,892 A | 12/2000 | Ver | |
| 6,181,753 B1 | 1/2001 | Takada et al. | |
| 6,201,872 B1 | 3/2001 | Hersh et al. | |
| 6,330,336 B1 | 12/2001 | Kasama | |
| 6,351,532 B1 | 2/2002 | Takada et al. | |
| 6,496,581 B1 | 12/2002 | Finn et al. | |
| 6,535,609 B1 | 3/2003 | Finn et al. | |
| 6,700,977 B2 | 3/2004 | Sugiyama | |
| 6,891,347 B2 | 5/2005 | Dobbs et al. | |
| 6,895,094 B1 | 5/2005 | Scalart et al. | |
| 6,944,304 B1 | 9/2005 | Dance et al. | |
| 7,017,702 B2 | 3/2006 | Gunby | |
| 7,017,707 B2 | 3/2006 | Zia et al. | |
| 7,039,207 B1 | 5/2006 | Elrod et al. | |
| 7,161,801 B2 | 1/2007 | Chen et al. | |
| 7,167,363 B1 | 1/2007 | Cushman et al. | |
| 7,317,801 B1 | 1/2008 | Amir | |
| 7,353,908 B1 | 4/2008 | French | |
| 7,853,024 B2 | 12/2010 | Slapak et al. | |
| 8,630,424 B2 | 1/2014 | Slapak et al. | |
| 8,855,329 B2 | 10/2014 | Slapak et al. | |
| 2001/0044719 A1 | 11/2001 | Casey | |
| 2002/0038215 A1 * | 3/2002 | Yamamoto ..... | B60R 11/0229 704/275 |
| 2002/0080978 A1 | 6/2002 | Kakuhari et al. | |
| 2002/0154481 A1 | 10/2002 | Wagner | |
| 2003/0053635 A1 | 3/2003 | Carme et al. | |
| 2003/0012980 A1 | 6/2003 | Vaishya | |
| 2003/0103635 A1 | 6/2003 | Wright et al. | |
| 2003/0107873 A1 | 6/2003 | Van Gaal | |
| 2003/0123675 A1 | 7/2003 | Culman et al. | |
| 2004/0081322 A1 | 4/2004 | Schliep et al. | |
| 2004/0210547 A1 | 10/2004 | Wentland et al. | |
| 2005/0170770 A1 | 8/2005 | Johnson et al. | |
| 2005/0232435 A1 | 10/2005 | Stothers et al. | |
| 2006/0188107 A1 | 8/2006 | Inoue et al. | |
| 2006/0285697 A1 * | 12/2006 | Nishikawa ..... | G10K 11/1788 381/71.1 |
| 2007/0003071 A1 | 1/2007 | Slapak et al. | |
| 2008/0317254 A1 | 12/2008 | Kano | |
| 2009/0003617 A1 * | 1/2009 | Goldman ..... | G10K 11/178 381/71.12 |
| 2010/0014685 A1 | 1/2010 | Wurm | |
| 2010/0028134 A1 | 2/2010 | Slapak et al. | |
| 2010/0104110 A1 | 4/2010 | Asao et al. | |
| 2010/0131269 A1 | 5/2010 | Park et al. | |
| 2010/0138427 A1 | 6/2010 | Van De Par et al. | |
| 2012/0288110 A1 | 11/2012 | Cherkassy et al. | |
| 2013/0133128 A1 | 5/2013 | Hein et al. | |
| 2014/0116632 A1 | 5/2014 | Domash | |

FOREIGN PATENT DOCUMENTS

| | | |
|---|---|---|
| EP | 0818771 | 1/1998 |
| EP | 0903726 | 3/1999 |
| EP | 0973151 | 1/2000 |
| EP | 1414021 | 4/2004 |
| EP | 2 119 628 | 11/2009 |
| EP | 2 251 860 | 11/2010 |
| JP | 06282279 | 10/1994 |
| JP | H08296335 | 11/1996 |
| JP | 2001067081 | 3/2001 |
| JP | 2001092469 | 4/2001 |
| JP | 2009029405 | 2/2009 |
| WO | 92 05538 | 4/1992 |
| WO | 9531805 | 11/1995 |
| WO | 00/047012 | 8/2000 |
| WO | 02/32356 | 4/2002 |
| WO | 05/027338 | 3/2005 |
| WO | 2009078146 | 6/2009 |

OTHER PUBLICATIONS

International Search Report and Written Opinion for PCT/IB2015/059996, dated May 5, 2016, 10 pages.
Office Action for Japanese Patent Application Serial No. 2014509878, dated May 24, 2016, 12 pages (Including 6 pages of English translation.).
www.worksafe.wa.gov.au/newsite/worksafe/default.html, 2 pages.
http://en.wikibooks.org/wiki/Acoustics/Noise_from_Cooling_Fans, 6 pages.
International Search Report for PCT/IL07/00269, dated Sep. 22, 2008, 1 page.
International Search Report for PCT/IL07/00270, dated Sep. 16, 2008, 1 page.

(56) References Cited

OTHER PUBLICATIONS

European Search Report for European Patent Application No. EP 02 02 3483, dated Apr. 8, 2003, 2 pages.
Office Action for European Patent Application No. EP 02 02 3483, dated Jan. 31, 2005, 4 pages.
Office Action for European Patent Application No. EP 0202 3483, dated Apr. 11, 2005, 4 pages.
Office Action for European Patent Application No. EP 0202 3483, dated Jul. 27, 2006, 3 pages.
International Search Report for PCT/IL04/00863, dated Feb. 25, 2005, 1 page.
International Search Report for PCT/IL08/00087, dated Sep. 23, 2008, 1 page.
European Search Report for European Patent Application No. 07713290.0, dated Feb. 28, 2013, 8 pages.
Office Action for U.S. Appl. No. 10/573,060, dated Oct. 2, 2008, 16 pages.
Office Action for U.S. Appl. No. 10/573,060, dated Apr. 30, 2009, 17 pages.
Office Action for U.S. Appl. No. 10/573,060, dated Sep. 4, 2009, 19 pages.
Office Action for U.S. Appl. No. 10/573,060, dated Feb. 4, 2010, 22 pages.
Office Action for Korean Patent Application No. 10-2006-7007389, dated Feb. 24, 2011, 10 pages, including 4 pages of English translation.
Office Action for U.S. Appl. No. 09/120,973, dated Jul. 17, 2003, 10 pages.
Office Action for U.S. Appl. No. 09/120,973, dated Sep. 12, 2003, 8 pages.
Office Action for U.S. Appl. No. 09/120,973, dated Mar. 24, 2004, 7 pages.
Office Action for U.S. Appl. No. 09/120,973, dated Jul. 12, 2004, 8 pages.
Office Action for U.S. Appl. No. 09/120,973, dated Dec. 16, 2004, 9 pages.
Office Action for U.S. Appl. No. 09/120,973, dated Dec. 15, 2005, 7 pages.
Office Action for U.S. Appl. No. 11/606,010, dated Nov. 24, 2009, 23 pages.
Office Action for U.S. Appl. No. 11/606,010, dated Sep. 17, 2008, 20 pages.
Office Action for U.S. Appl. No. 11/606,010, dated Jul. 7, 2009, 25 pages.
Office Action for U.S. Appl. No. 11/606,010, dated Apr. 1, 2009, 22 pages.
Office Action for U.S. Appl. No. 12/941,145, dated Nov. 13, 2012, 6 pages.
Office Action for U.S. Appl. No. 12/941,145, dated Mar. 25, 2013, 6 pages.
Office Action for U.S. Appl. No. 12/941,145, dated Jul. 1, 2013, 12 pages.
International Preliminary Report on Patentability for International Application No. PCT/IL2008/000087, dated Sep. 23, 2008, 9 pages.
International Search Report and Written Opinion for PCT/IB12/52333, dated Nov. 14, 2012, 16 pages.
International Preliminary Report on Patentability for PCT/IB12/52333, dated Nov. 21, 2013, 8 pages.
Office Action for U.S. Appl. No. 12/449,068, dated Jun. 24, 2013, 33 pages.
Office Action for U.S. Appl. No. 12/449,068, dated Jan. 30, 2014, 37 pages.
Office Action for Chinese Patent Application No. 201280026024.3, dated Jan. 7, 2015, 18 pages, including 9 pages of English translation.
Extended European Search Report for European Patent Application No. 12782754.1, dated Aug. 20, 2015, 7 pages.
Sen M Kuo et al., "Active Noise Control: A Tutorial Review," Proceedings of the IEEE, IEEE, vol. 87, No. 6, Jun. 1999, XP011044219, pp. 943-973, 31 pages, New York, USA.
Office Action and Search Report of Chinese Patent Application No. 2012800260243, dated Sep. 17, 2015, 15 pages (including 7 pages of English translation).
Office Action for U.S. Appl. No. 13/468,170 dated Sep. 3, 2015, 14 pages.
Office Action for U.S. Appl. No. 13/468,170 dated Jan. 23, 2015, 30 pages.
Notice of Allowance for U.S. Appl. No. 13/468,170 dated Feb. 12, 2016, 15 pages.
Office Action for Korean Patent Application No. 10-2013-7031401, dated May 30, 2017, 5 pages.(Including 2 pages of English translation).
International Preliminary Report on Patentability for PCT/IB2015/059996, dated Jul. 13, 2017, 7 pages.

* cited by examiner

APPARATUS, SYSTEM AND METHOD OF CONTROLLING NOISE WITHIN A NOISE-CONTROLLED VOLUME

CROSS REFERENCE

This application claims the benefit of and priority from U.S. Provisional Patent Application No. 62/097,086 entitled "Apparatus, System and Method of Noise Reduction", filed Dec. 28, 2014, and is a Continuation In Part (CIP) of U.S. patent application Ser. No. 13/468,170 entitled "Device System and Method of Noise Control", filed May 10, 2012, which claims the benefit of and priority from U.S. Provisional Patent Application No. 61/484,722 entitled "Device, System and Method of Noise Control", filed May 11, 2011, the entire disclosures of all of which are incorporated herein by reference.

TECHNICAL FIELD

Some embodiments described herein generally relate to controlling noise in a noise-controlled volume.

BACKGROUND

Noise in general, and tonal noise in particular is very annoying. Low-frequency noise is very penetrating, travels very long distances and is difficult to attenuate using traditional passive control measures.

Passive noise control technology, which usually involves using absorptive materials or noise partitions, enclosures, barriers and silencers, can be bulky, ineffective and rather expensive at low frequencies. Active Noise Control (ANC), on the other hand, can be very efficient and relatively cheaper in reducing low-frequency noise.

Active Noise Control (ANC) is a technology using noise to reduce noise. It is based on the principle of superposition of sound waves. Generally, sound is a wave, which is traveling in space. If another, second sound wave having the same amplitude but opposite phase to the first sound wave can be created, the first wave can be totally cancelled. The second sound wave is named "anti-noise".

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
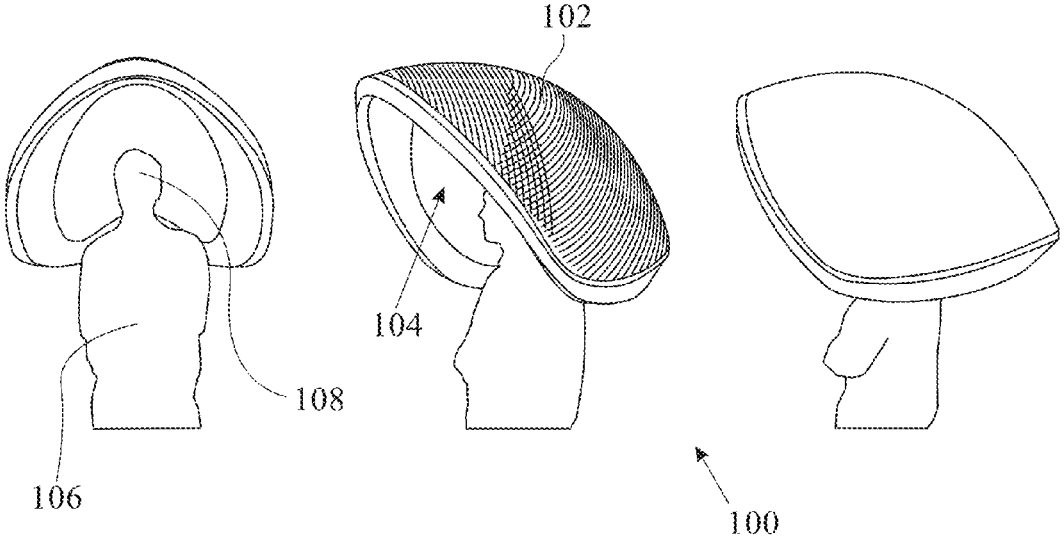
FIG. 1 is a schematic illustration of a noise control system including a sheltering structure, in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality", as used herein, include, for example, "multiple" or "two or more". For example, "a plurality of items" includes two or more items.

References to "one embodiment," "an embodiment," "demonstrative embodiment," "various embodiments," etc., indicate that the embodiment(s) so described may include a particular feature, structure, or characteristic, but not every embodiment necessarily includes the particular feature, structure, or characteristic. Further, repeated use of the phrase "in one embodiment" does not necessarily refer to the same embodiment, although it may.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Some portions of the following detailed description are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

As used herein, the term "circuitry" may refer to, be part of, or include, an Application Specific Integrated Circuit (ASIC), an integrated circuit, an electronic circuit, a processor (shared, dedicated, or group), and/or memory (shared, dedicated, or group), that execute one or more software or firmware programs, a combinational logic circuit, and/or other suitable hardware components that provide the described functionality. In some embodiments, the circuitry may be implemented in, or functions associated with the circuitry may be implemented by, one or more software or firmware modules. In some embodiments, circuitry may include logic, at least partially operable in hardware.

The term "logic" may refer, for example, to computing logic embedded in circuitry of a computing apparatus and/or computing logic stored in a memory of a computing apparatus. For example, the logic may be accessible by a processor of the computing apparatus to execute the computing logic to perform computing functions and/or operations. In one example, logic may be embedded in various types of memory and/or firmware, e.g., silicon blocks of various chips and/or processors. Logic may be included in, and/or implemented as part of, various circuitry, e.g. radio circuitry, receiver circuitry, control circuitry, transmitter circuitry, transceiver circuitry, processor circuitry, and/or the like. In one example, logic may be embedded in volatile memory and/or non-volatile memory, including random access memory, read only memory, programmable memory, magnetic memory, flash memory, persistent memory, and the like. Logic may be executed by one or more processors using memory, e.g., registers, stuck, buffers, and/or the like, coupled to the one or more processors, e.g., as necessary to execute the logic.

Some demonstrative embodiments include systems and methods, which may be efficiently implemented for controlling acoustic signals, for example noise, for example, to reduce or eliminate undesirable noise, e.g., as described below.

Some demonstrative embodiments may include a noise control system ("also referred to as "noise reduction system"), which may be configured to maintain a noise controlled volume (also referred to as "noise controlled zone", "quiet zone", "shelter zone", "comfort zone", "acoustic controlled environment", "reduced noise environment", "quiet environment", and/or "reduced noise zone"), in which noise energy ("the external noise energy" or "external noise") from one or more noise sources external to the noise-controlled volume, e.g., noise from an environment external to the noise controlled volume, may be controlled, managed, altered, adjusted, manipulated, reduced or even eliminated, e.g., as described below.

In some demonstrative embodiments, the noise control system may be configured to form a "noise shelter", which may be configured to shelter, protect, and/or shield at least one user, for example, at least the ears of the user, e.g., at least a head of the user, from the external noise energy, e.g., as described below.

In some demonstrative embodiments, the noise control system may include a sheltering structure, which may be configured to at least partially surround a noise controlled volume, e.g., as described below.

In some demonstrative embodiments, the noise control system may be configured, for example, to enable to reduce, or even eliminate, the external noise energy, which may be heard by the user, for example, when the head of the user is within the noise controlled volume, e.g., as described below.

In some demonstrative embodiments, the sheltering structure may include an inner surface at least partially surrounding the noise controlled volume, e.g., as described below.

In some demonstrative embodiments, at least part of an outer surface of the sheltering structure may be exposed to, or in contact with, an environment, which may include one or more noise sources generating the external noise, e.g., as described below.

In some demonstrative embodiments, the sheltering structure may include at least one opening, which may be configured to allow insertion of at least a head of at least one user into the noise-controlled volume, e.g., as described below.

In some demonstrative embodiments, the sheltering structure may include a box-like structure partially surrounding the noise-controlled volume, e.g., as described below.

In some demonstrative embodiments, the sheltering structure may include a shell-like structure partially surrounding the noise-controlled volume, e.g., as described below.

In some demonstrative embodiments, the sheltering structure may include a hood-like structure configured to at least partially surround the noise-controlled volume, e.g., as described below.

In some demonstrative embodiments, the sheltering structure may be in the form of a cover-like structure, a canopy-like structure, or a structure of any other shape or form, which may be configured to at least partially enclose, surround, shelter, shield, confine, contain, and/or cover the noise-controlled volume, e.g., as described below.

In other embodiments, the sheltering structure may have a spherical shape, a cubic shape, a pyramid shape, and/or any other shape.

In some demonstrative embodiments, the sheltering structure may be configured to at least partially surround at least the ears of at least one user, for example, at least the head of at least one user, e.g., as described below.

In some demonstrative embodiments, the sheltering structure may be configured to enable the user to insert at least the head of the user into the noise-controlled volume and/or to remove the head of the user from the noise-controlled volume, e.g., in a comfortable, user-friendly, and/or quick manner.

Some demonstrative embodiments are described below with respect to a noise control system including a sheltering structure configured for a single user. However, in other embodiments the noise control system may include a sheltering structure configured to provide a noise shelter to more than one user, e.g., to a group of users.

In some demonstrative embodiments, the noise control system may include an Active Noise Control (ANC) system (also referred to as "Active Noise Reduction (ANR) system") configured to control, reduce and/or eliminate the external noise energy, for example, within the noise-controlled volume, e.g., as described below.

In some demonstrative embodiments, one or more elements of the ANC system may be embedded in or connected to one or more elements of the sheltering structure, for example, within the sheltering structure, and/or on one or more surfaces of the sheltering structure, e.g., as described below.

In some demonstrative embodiments, the noise control system may include one or more first acoustic sensors (also referred to as "reference noise sensors", "reference microphones (MICs)", and/or "Noise MICs") to sense the external noise at one or more respective noise sensing locations on the outer surface of the sheltering structure, e.g., as described below. The acoustic sensors may include, for example, one or more microphones, accelerometers, tachometers, and the like.

In some demonstrative embodiments, the noise control system may include one or more second acoustic sensors (also referred to as "residual noise sensors", "residual microphones (MICs)", and/or "error MICs") to sense residual noise at one or more respective residual noise sensing locations on the inner surface of the sheltering structure, e.g., as described below.

In some demonstrative embodiments, the noise control system may include one or more acoustic transducers (also referred to as "speakers (SPKRs)", and/or "loudspeakers"), which may be controlled to produce acoustic signals, for example, within the noise controlled volume, e.g., as described below.

In some demonstrative embodiments, the noise control system may include a controller component configured to determine a noise control pattern based at least on one or more first noise inputs from the one or more first acoustic sensors and one or more second noise inputs from the one or more second acoustic sensors, e.g., as described below.

In some demonstrative embodiments, the controller component may be configured to generate one or more control signals to control acoustic signals generated by the one or more acoustic transducers based on the noise control pattern, e.g., as described below.

In some demonstrative embodiments, the controller component may be configured to determine the noise control pattern configured to reduce or eliminate a noise pattern in the noise-controlled volume resulting from the external noise, e.g., as described below.

In some demonstrative embodiments, the noise control system may be configured to be placed at a noisy location, for example, a street, a train station, a metro station, an office, an "open space" room, an airport, a club, a bar, a stadium, a hotel lobby, a hospital, a convention center, a coffee shop, a store, a shopping mall, and/or any other indoor and/or outdoor location.

In some demonstrative embodiments, one or more elements of the noise control system, for example, one or more elements of the ANC system, may be configured and/or customized, for example, based on one or more attributes of the location at which the noise reduction system is to be placed, and/or based on one or more types of external noise sources, which may be expected to be at the location, e.g., as described below.

In some demonstrative embodiments, the noise control system may be configured to provide the user with the ability to enjoy the reduced noise level in the noise controlled volume, for example, while shielding the user from external noise from the noisy location.

In one example, the noise control system may be configured to allow the user to participate in a conversation using a cell-phone or any other communication device, for example, while reducing, or even eliminating, the affect and/or interference of the external noise on the conversation.

In another example, the noise control system may be configured to enable the user to listen to audio signals, which may be produced, for example, by a speaker of a device, e.g., an audio or video mobile device carried by the user, and/or an audio and/or video device which may be part of the noise control system and/or placed within the noise controlled volume.

In other embodiments, the noise control system may be configured to enable the user to enjoy the benefits of the noise-controlled volume for any other additional or alternative use.

In some demonstrative embodiments, the noise control system may be configured to allow the user to listen to audible signals, which may be produced within the noise-controlled volume, for example, while reducing, or even eliminating, the affect of the external noise in the noise controlled volume, e.g., as described below.

In some demonstrative embodiments, the audible signals may include audible signals generated by the user, for example, speech signals of the user.

In some demonstrative embodiments, the audible signals may include audible signals generated by a device, for example, a speaker, within the quiet zone.

In some demonstrative embodiments, the speaker may include a speaker of a phone or another communication device, which may be held by the user within the quiet zone, e.g., as described below.

In some demonstrative embodiments, the speaker may be part of the noise control system. For example, the speaker may be configured to generate audio ("private audio") to be heard by the user within the quiet zone.

In some demonstrative embodiments, the noise control system may be configured, for example, to allow the user to communicate speech signals from the user, for example, using a phone or any other communication device, while, for example, reducing, or even eliminating, the affect of the external noise on the speech signals of the user, e.g., as described below.

In some demonstrative embodiments, the noise control system may be configured to provide to the user in the noise-controlled volume input audio to be heard within the noise-controlled volume, e.g., as described below.

In some demonstrative embodiments, the noise control system may include an input audio interface to receive the input audio, e.g., as described below.

In some demonstrative embodiments, the input audio interface may include, for example, a communication interface to receive the input audio from a user device, for example, via a wired and/or wireless communication link, e.g., as described below.

In some demonstrative embodiments, the controller component of the noise control system may be configured to control at least one acoustic transducer of the one or more acoustic transducers to generate audio signals based on input audio to be heard within the noise-controlled volume, e.g., as described below.

In some demonstrative embodiments, the controller component of the noise control system may be configured to determine the noise control pattern based on the input audio to be heard within the noise-controlled volume, e.g., as described below.

In some demonstrative embodiments, the controller component of the noise control system may be configured to determine a noise reduction pattern based on the one or more first noise inputs and the one or more second noise inputs, and to determine the noise control pattern based on a combination of the noise reduction pattern and an input audio pattern corresponding to the input audio, e.g., as described below.

In some demonstrative embodiments, the controller component of the noise control system may be configured to determine a processed audio pattern by applying to the input audio pattern a function, which is based on one or more paths between the one or more second acoustic sensors and the one or more acoustic transducers, e.g., as described below.

In some demonstrative embodiments, the controller component of the noise control system may be configured to determine the noise reduction pattern based on a difference between the one or more second noise inputs and the processed audio pattern, e.g., as described below.

In some demonstrative embodiments, the controller component of the noise control system may be configured to determine a processed noise reduction pattern by applying to the noise reduction pattern another function, which is based on one or more paths between the one or more first acoustic sensors and the one or more acoustic transducers, e.g., as described below.

In some demonstrative embodiments, the controller component of the noise control system may be configured to determine the noise reduction pattern based on a difference between the one or more first noise inputs and the processed noise reduction pattern, e.g., as described below.

Reference is made to FIG. 1, which schematically illustrates a noise control system 100 including a sheltering structure 102, in accordance with some demonstrative embodiments.

In some demonstrative embodiments, as shown in FIG. 1, sheltering structure 102 may include a hood-like structure 102 configured to partially enclose a volume 104, which may controlled to serve as a noise-controlled volume or a quiet zone for a user 106, for example, when a head 108 of user 106 is placed within the noise-controlled volume 104.

In some demonstrative embodiments, sheltering 102 may include a shell-like structure, as shown in FIG. 1.

In other embodiments, sheltering structure 102 may be in any other form or shape, for example, a box shape, e.g., as described below with reference to FIG. 4, a spherical shape, a cylindrical shape, a pyramid shape, a cubic shape, or any other shape.

In some demonstrative embodiments, noise control system 100 may be configured to perform the functionality of a "Comfort Shell™ (CS™)" or a "Noise Shelter™", which may be placed at a location, for example, a noisy location or any other location, and may be configured to controllably maintain a quiet zone within the volume 104 sheltered by sheltering structure 102, e.g., as described below.

In some demonstrative embodiments, as shown in FIG. 1, noise control system 100 may be configured to allow the user 106 to benefit from a private "Audio Comfort Zone™" (also referred to as "Comfort Zone™").

In some demonstrative embodiments, noise control system 100 may be configured to allow user 106 to listen to audible signals within the audio comfort zone, for example, while reducing, or even eliminating, external noise from one or more noise sources external to the audio comfort zone.

In one example, noise control system 100 may be configured to allow user 106 to conduct a conversation, for example, using a cell phone, or any other communication device, for example, while reducing, or even eliminating, external noise from one or more noise sources external to the noise controlled volume 140, which is sheltered by sheltering structure 102.

In one example, noise control system 100 may be configured to allow user 106 to listen to music, watch a video, and/or listen to any other audible signals, for example, while reducing, or even eliminating, external noise from one or more noise sources external to the audio comfort zone maintained within the noise controlled volume 104.

In some demonstrative embodiments, noise control system 100 may be configured for being placed in a variety of indoor and/or outdoor environments, for example, noisy environments.

In some demonstrative embodiments, noise control system 100 may be configured for being placed at a train station, an airport, a public location, a private location, a stadium, a theater, a street, a mall, and/or any other location.

In some demonstrative embodiments, noise control system 100 may be configured to create and/or controllably maintain the quiet zone, for example, using one or more elements of ANR system, e.g., as described below.

In some demonstrative embodiments, noise control system 100 may optionally utilize one or more passive noise reduction mechanisms, for example, passive noise isolation, for example, in combination with the ANR system, e.g., as described below.

In some demonstrative embodiments, the passive isolation may be facilitated, for example, by blocking the noise using the sheltering structure 102, e.g., the shell structure.

In some demonstrative embodiments, sheltering structure 102 may include at least one passive noise reduction component to absorb at least a predefined spectrum of the external noise, e.g., as described below.

In some demonstrative embodiments, noise control system 100 may include one or more layers of material configured to provide the passive isolation.

In one example, sheltering structure 102 may include one or more layers of noise insulation material, for example, a noise absorbing material and/or a noise blocking material, e.g., as described below.

In some demonstrative embodiments, the passive isolation provided by sheltering structure 102 may be, for example, most effective for high frequencies.

In some demonstrative embodiments, noise control system 100 may include one or more acoustic actuators, for example, one or more loudspeakers (speakers), e.g., an array of speakers, which may be, for example, distributed on or within sheltering structure 102, e.g., as described below.

In some demonstrative embodiments, noise control system 100 may include a controller, e.g., an ANR controller, which may be configured to control the acoustic actuators to generate an anti-noise signal, which may be controllable to, when transmitted within the noise controlled volume 104, to reduce or eliminate the external noise from one or more noise sources external to the noise controlled volume 104, e.g., as described below.

In some demonstrative embodiments, noise control system 100 may include one or more first acoustic sensors (not shown in FIG. 1) to sense external noise at one or more respective noise sensing locations on an outer surface of sheltering structure 102, e.g., as described below.

In some demonstrative embodiments, noise control system 100 may include one or more second acoustic sensors (not shown in FIG. 1) to sense residual noise at one or more respective residual noise sensing locations on an inner surface of sheltering structure 102, e.g., as described below.

In some demonstrative embodiments, noise control system 100 may include a controller component (not shown in FIG. 1) configured to determine a noise control pattern based at least on one or more first noise inputs from the one or more first acoustic sensors and one or more second noise inputs from the one or more second acoustic sensors, and to generate one or more control signals to control acoustic signals generated by the one or more acoustic transducers based on the noise control pattern, e.g., as described below.

In some demonstrative embodiments, sheltering structure 102 may be configured, for example, such that one or more reference microphones are on a first side of the passive noise reduction component, e.g., to sense the external noise before the external noise arrives at the passive noise reduction components; and/or one or more error microphones are on a second side, opposite to the first side, of the passive noise reduction component, e.g., to sense the residual noise, as described below.

In some demonstrative embodiments, noise control system 100 may be configured to provide input audio signals (also referred to as "private audio") to be heard by user 106 within the audio comfort zone provided by noise-control volume 104, for example, in a private manner, e.g., while not being heard outside of the audio comfort zone provided by noise-control volume 104, e.g., as described below.

In some demonstrative embodiments, the private audio may include, for example, music, and/or audio of a video to be presented to user 106 within the audio comfort zone.

In some demonstrative embodiments, the private audio may include, for example, audio of a conversation conducted by user 106.

For example, noise control system 100 may be configured to communicate with a cellular phone of user 106, e.g., via a wired link, e.g., via a Universal Serial Bus (USB) cable, and/or wireless link, for example, a Bluetooth link, a Wi-Fi link, and the like, and to receive from the cellular phone wireless signals including information of audio to be sounded to user 106. According to this example, noise reduction system 100 may be configured to sound the audio to user 106 via one or more speakers of noise reduction system 100.

In some demonstrative embodiments, noise control system 100 may be configured to transmit the private audio using one or more of the acoustic actuators of the ANR system. For example, noise control system 100 may be configured to control the acoustic actuators of the ANR system to generate audio signals, which are a combination of the noise destructive signals and signals of the private audio, e.g., as described below.

In some demonstrative embodiments, noise control system 100 may include one or more dedicated acoustic actuators, for example, one or more dedicated speakers, to produce the private audio, e.g., separate from the noise destructive signals generated by the ANR system.

In some demonstrative embodiments, noise control system 100 may also include one or more power sockets, for example, to enable user 106 to charge a battery of one or more mobile devices, e.g., a Smartphone, a laptop, and the like.

In some demonstrative embodiments, noise control system 100 may also include one or more wireless communication modules, for example, a wired communication interface, and/or a wireless communication interface, for example, a Wireless Local Area Network (WLAN) module, e.g., a WiFi Access Point (AP), to provide wireless connectivity, e.g., wireless Internet connectivity, to one or more mobile devices, e.g., a Smartphone, a laptop, and the like.

In some demonstrative embodiments, noise control system 100 may also include one or more video, graphic, textual, and/or visual modules to display images, text, and/or video to user 106.

In one example, noise control system 100 may include a display, e.g., a front glass, to display images and/or video, e.g., 2-dimensional images, 3-dimensional images, and/or holograms, to user 106. In one example, the display may be implemented as part, e.g., embedded as part of, and/or forming a surface of, sheltering structure 102.

In some demonstrative embodiments, noise control system 100 may include or may be implemented as part of one or more other devices, which may be configured to provide one or more functionalities and/or services to user 106, for example, a coffee machine, a vending machine, and the like.

In some demonstrative embodiments, noise control system 100 may allow user 106 to enjoy an environment with reduced noise, e.g., a quiet and/or relaxed environment, for example, to make an important phone call, to prepare for a big exam, to read a book, to relax, to watch a video, to listen to music, to play a computer game, to take a nap, and/or to perform any other activity, for example, even at a noisy environment, e.g., a street, a bus stop, a shopping mall, a hotel lobby, a stadium, a metro station, an airport, at an office, at home, or at any other location.

In some demonstrative embodiments, noise control system 100 may allow user 106 to enjoy various benefits, for example, the ability to create desired audio environments, e.g., at home or at any other location; to boost productivity at home and/or at work, e.g., in an "open space" office; to get a moment's peace while out at the mall, cafe, airport, train station, and the like; to only hear what the user 106 wants to, when user 106 wants to; to feel better, e.g., controlling the noise environment may lead to better health and restful sleep; and/or for any other benefit or activity.

Figure 2:
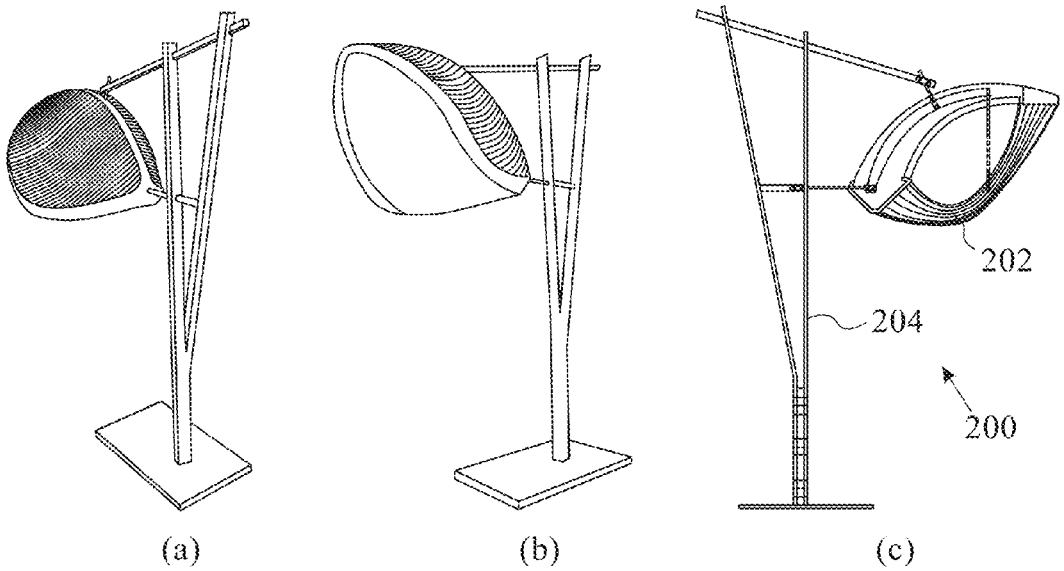
FIG. 2 is a schematic illustration of a noise control system including a sheltering structure, in accordance with some demonstrative embodiments.

Reference is made to FIG. 2, which schematically illustrates a noise control system 200, in accordance with some demonstrative embodiments. For example, noise control system 200 may perform one or more operations and/or functionalities of noise control system 100 (FIG. 1).

As shown in FIG. 2, in some demonstrative embodiments, noise control system 200 may include a hood-like sheltering structure 202, which may be suspended on a stand structure 204, e.g., a pole.

In some demonstrative embodiments, hood-like structure 202 may be placed and/or positioned using a stand, e.g., stand 204, which may be placed on a floor, e.g., as shown in FIG. 2.

In other embodiments, hood-like structure 202 may be suspended using any other mechanism, e.g., a wire or a string, which may be connected to a ceiling, and/or an arm, which may be connected to a wall, and the like.

In some demonstrative embodiments, hood-like structure 202 may perform one or more functionalities of sheltering structure 102 (FIG. 1), e.g., as described above.

In some demonstrative embodiments, noise control system 200 may be configured for use, for example, in a train station or any other location or environment, to enable individuals the benefit of a quiet environment, e.g., while waiting for a train. For example, the quiet environment may facilitate a convenient phone call environment, e.g., as described above.

In some demonstrative embodiments, stand 204 may be configured to maintain hood-like structure 202, for example, at a height of about 2 meters above the ground, or any other height, e.g., to facilitate comfortable access to most of the population.

In other embodiments, stand 204 may be configured to maintain hood-like structure 202 above a chair or a bench, for example, to enable the user to enjoy the quiet environment, e.g., while sitting down.

In some demonstrative embodiments, hood-like structure 202 may have a shell-like shape, for example, having a width of about 1.5 meters, and/or a height of about 1.5 meters. In other embodiments, hood-like structure 202 may have any other shape and/or dimensions.

Figure 3:
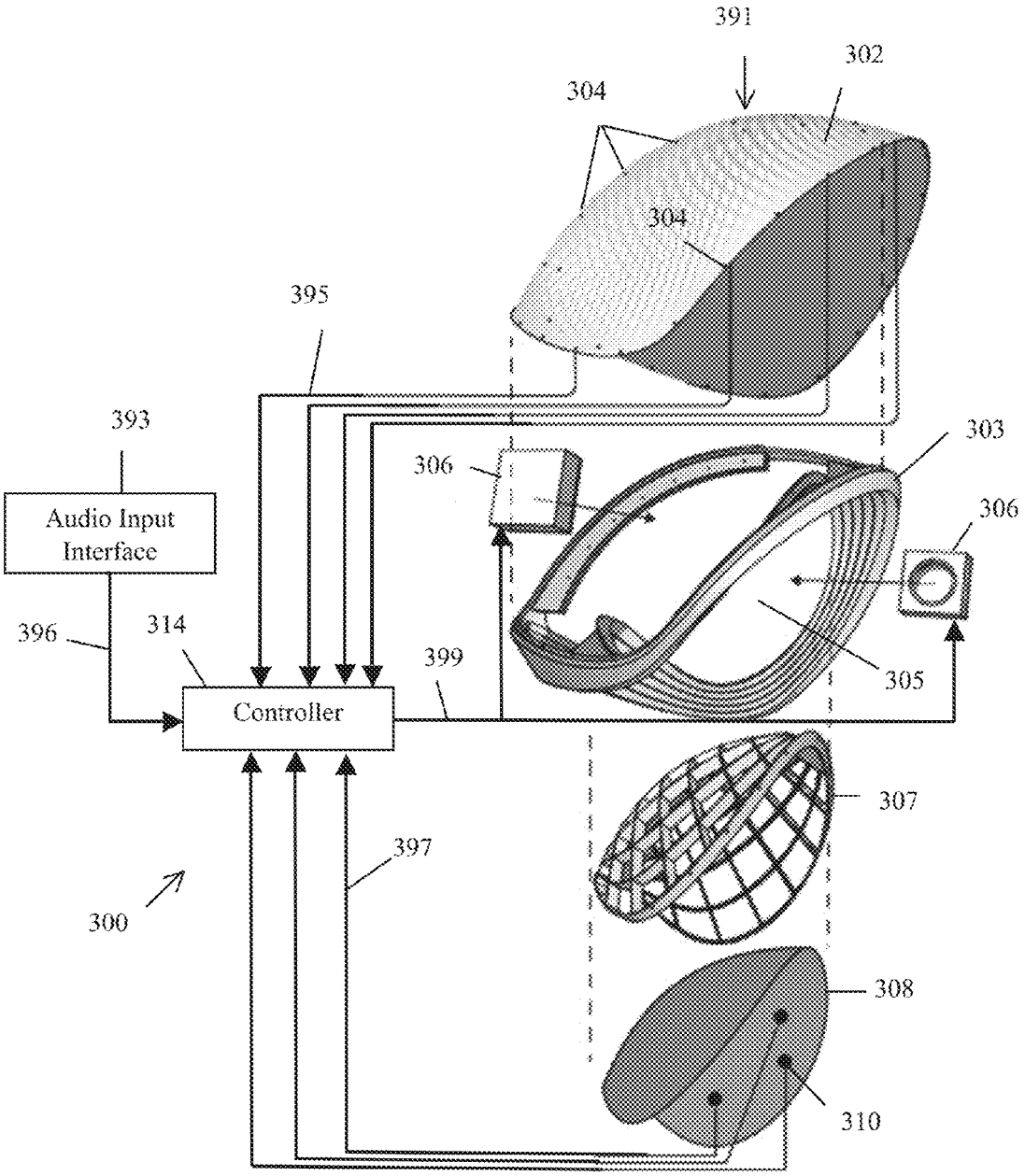
FIG. 3 is a schematic illustration of elements of a noise control system, in accordance with some demonstrative embodiments.

Reference is made to FIG. 3, which schematically illustrates elements of a noise control system 300, in accordance with some demonstrative embodiments. For example, noise reduction system 300 may be implemented by, and/or may perform the one or more functionalities and/or operations of noise control system 100 (FIG. 1) and/or noise control system 200 (FIG. 2).

In some demonstrative embodiments, noise control system 300 may include a hood-like sheltering structure 391 including an external layer 302, a frame structure 303, an internal structure 307, and a passive noise reduction layer 308, e.g., as described below.

In some demonstrative embodiments, external layer 302 may be formed, for example, of a plastic material, a metallic material, a compound material, a galls material, or any other material.

In some demonstrative embodiments, noise control system 300 may include one or more first acoustic sensors 304, e.g., a plurality of acoustic sensors 304, to sense external noise at one or more respective noise sensing locations on an outer surface of the sheltering structure 391, e.g., on a surface of layer 302.

In some demonstrative embodiments, as shown in FIG. 3, noise control system 300 may include a plurality of acoustic sensors 304 distributed to sense the external noise at a respective plurality of different locations on the outer surface of layer 302.

In some demonstrative embodiments, one or more of acoustic sensors 304, e.g., some or all of acoustic sensors 304, may be embedded within the outer surface of the sheltering structure 391, e.g., embedded within or under layer 302.

In some demonstrative embodiments, one or more of reference microphones 304 may be connected to the outer surface of external layer 302, and/or embedded within external layer 302.

In some demonstrative embodiments, as shown in FIG. 3, one or more of acoustic sensors 304 may be on a first side of passive noise reduction layer 308, and one or more of acoustic sensors 310 may be on a second side, opposite to the first side, of the passive noise reduction layer 308.

In some demonstrative embodiments, frame structure 303 may be configured to support external layer 302 and to define an internal volume 305 to house one or more acoustic transducers, for example, one or more speakers 306.

In some demonstrative embodiments, the one or more speakers 306 may include one or more speakers (also referred to as "ANR speakers") to generate one or more noise control acoustic signals; and/or one or more private audio speakers, for example, to generate acoustic signals of private audio, e.g., as described above.

In some demonstrative embodiments, one or more of the speakers 306 may be controlled to generate a combination of the noise control acoustic signals and the acoustic signals of private audio, e.g., as described above.

In some demonstrative embodiments, internal structure 307 may be configured to support speakers 306, frame structure 303, external layer 302, and/or passive noise reduction layer 308.

In some demonstrative embodiments, internal structure 307 may include a two-dimensional or three-dimensional truss structure, which may include a plurality of openings, which may be configured to enable audio signals to travel from speakers 306 to the noise controlled volume within the sheltering structure 391.

In some demonstrative embodiments, passive noise-reduction layer 308 may be formed of a material configured to passively block and/or absorb at least one predefined spectrum of external noise external to the noise controlled volume. For example, passive noise-reduction layer 308 may be formed of a material configured to block and/or absorb audio signals of high frequencies.

In some demonstrative embodiments, noise control system 300 may include one or more acoustic sensors 310 ("error microphones") to sense residual noise at one or more respective residual noise sensing locations on an inner surface of the sheltering structure 391, e.g., an inner surface of layer 308, as shown in FIG. 3.

In some demonstrative embodiments, as shown in FIG. 3, noise control system 300 may include a plurality of acoustic sensors 310 distributed to sense the residual noise at a respective plurality of different locations on the inner surface of layer 308.

In some demonstrative embodiments, one or more of acoustic sensors 310 may be embedded within the inner surface of the sheltering structure 391. For example, one or more of acoustic sensors 310 may be located on, connected to, or embedded within, passive noise-reduction layer 308, and/or any other portion of the sheltering structure 391.

In some demonstrative embodiments, the one or more acoustic sensors 304 may be configured to generate one or more respective noise inputs 395, for example, representing the external noise sensed at the one or more locations on the outer surface of sheltering structure 391.

In some demonstrative embodiments, the one or more acoustic sensors 310 may be configured to generate one or more respective noise inputs 397, for example, representing the residual noise sensed at the one or more locations on the inner surface of sheltering structure 391.

In some demonstrative embodiments, noise control system 300 may include a controller component 314 configured to control acoustic signals to be generated by the one or more acoustic transducers 306, e.g., as described below.

In some demonstrative embodiments, controller component 314 may include circuitry and/or logic, for example, one or more processors including circuitry and/or logic, memory circuitry and/or logic, ANC circuitry and/or logic, ANR circuitry and/or logic, and/or any other circuitry and/or logic, configured to perform the functionality of controller 314. Additionally or alternatively, one or more functionalities of controller 314 may be implemented by logic, which may be executed by a machine and/or one or more processors, e.g., as described below. In one example, controller component 314 may include, or may be implemented as part of an integrated circuit, for example, a System on Chip (SIC).

In some demonstrative embodiments, controller component 314 may be connected to, or embedded within one or more elements of the sheltering structure 391.

In some demonstrative embodiments, controller component 314 be configured to determine a noise control pattern based at least on one or more of noise inputs 395 and/or one or more of noise inputs 397, e.g., as described below.

In some demonstrative embodiments, controller component 314 may be configured to generate one or more control signals 399 to control acoustic signals generated by the one or more acoustic transducers 306 based on the noise control pattern, e.g., as described below.

In some demonstrative embodiments, controller component 314 may be configured to determine the noise control pattern configured to reduce or eliminate a noise pattern in the noise-controlled volume, e.g., defined by the inner surface of sheltering structure 391, resulting from the external noise, e.g., from an environment the outer surface of sheltering structure 391, as described below.

In some demonstrative embodiments, controller component 314, acoustic sensors 304, acoustic sensors 310, and/or acoustic transducers 306 may be configured to perform one or more ANC and/or ANR operations, algorithms and/or mechanisms of an ANR system, which may be configured to reduce or even eliminate at least external noise of mid-frequencies and/or low frequencies, e.g., as described below.

In some demonstrative embodiments, reference microphones 304 may be distributed to receive the environmental noise to be cancelled (unwanted noise), e.g., by the ANR system, and to forward noise inputs 395 corresponding to the captured noise to controller 314, e.g., as described below.

In some demonstrative embodiments, error microphones 310 may be configured to sense a residual noise at one or more locations within, and/or on the perimeter of, the noise-controlled volume, for example, to enable the controller 314 to monitor how well the ANR system performs and/or to controllably adjust noise cancellation acoustic signals produced by speakers 306, e.g., as described below.

In some demonstrative embodiments, speakers 306 may be configured to produce the acoustic signals, e.g., including anti-noise signals, for example, according to control signals 399 form the controller 314, e.g., as described below.

In some demonstrative embodiments, controller 314 may include, for example, logic and./or circuitry, for example, in the form of a digital signal processor, which may be configured to control speakers 306 using one or more control signals 399. For example, controller 314 may receive the reference signals 395 from the reference microphones 304, and the error signals 397 from the error microphones 310, and, for example, based at least on the reference signals 395 and the error signals 397, the controller 314 may determine the control signals 399 to control the speakers 306, e.g., as described below.

In some demonstrative embodiments, controller component 314 may be configured to control at least one acoustic transducer 306 to generate audio signals based on input audio 396 to be heard within the noise-controlled volume, e.g., as described below.

In some demonstrative embodiments, controller component 314 may be configured to determine the noise control pattern, which may be used to control speakers 306, for example, based on the input audio 396 to be heard within the noise-controlled volume defined by sheltering structure 391, e.g., as described below.

In some demonstrative embodiments, noise control system may include at least one audio input interface 393, e.g., including a communication interface, to receive the input audio 396, for example, from a user device, from a storage device, from a network, and/or from any other source. In one example, audio input interface may include a wired or wireless communication interface to receive signals of audio input 106, for example, from a user device, for example, a computing device held by a user of noise control system 300.

In some demonstrative embodiments, controller component 314 may be configured to determine a noise reduction pattern based on noise inputs 395 and noise inputs 397, and to determine the noise control pattern based on a combination of the noise reduction pattern and an input audio pattern corresponding to the input audio 396, e.g., as described below.

In some demonstrative embodiments, controller component 314 may be configured to determine a processed audio pattern by applying to the input audio pattern a function, which is based on one or more paths between acoustic sensors 310 and the one or more acoustic transducers 306, and to determine the noise reduction pattern based on a difference between the noise inputs 397 from acoustic transducers 310 and the processed audio pattern, e.g., as described below.

In some demonstrative embodiments, controller component 314 may be configured to determine a processed noise reduction pattern by applying to the noise reduction pattern another function, which is based on one or more paths between the one or more acoustic sensors 304 and the one or more acoustic transducers 306, and to determine the noise reduction pattern based on a difference between the one or more noise inputs 395 from the one or more acoustic sensors 304 and the processed noise reduction pattern, e.g., as described below.

In some demonstrative embodiments, controller component 314 may be configured to extract from noise inputs 395 a plurality of disjoint reference acoustic patterns, which are statistically independent, and to determine the noise control pattern to control acoustic transducers 306 based on at least one disjoint reference acoustic pattern of the plurality of disjoint reference acoustic patterns, e.g., as described below.

Some demonstrative embodiments may include a noise control system including a sheltering structure in the shape of a shell, e.g., as described above with reference to FIG. 3. In other embodiments, a noise control system including a sheltering structure of any other suitable shape and/or form. For example, the noise control system may include a box-shaped, for example, a box shape, which is open on at least one side, e.g., as described below.

Figure 4:
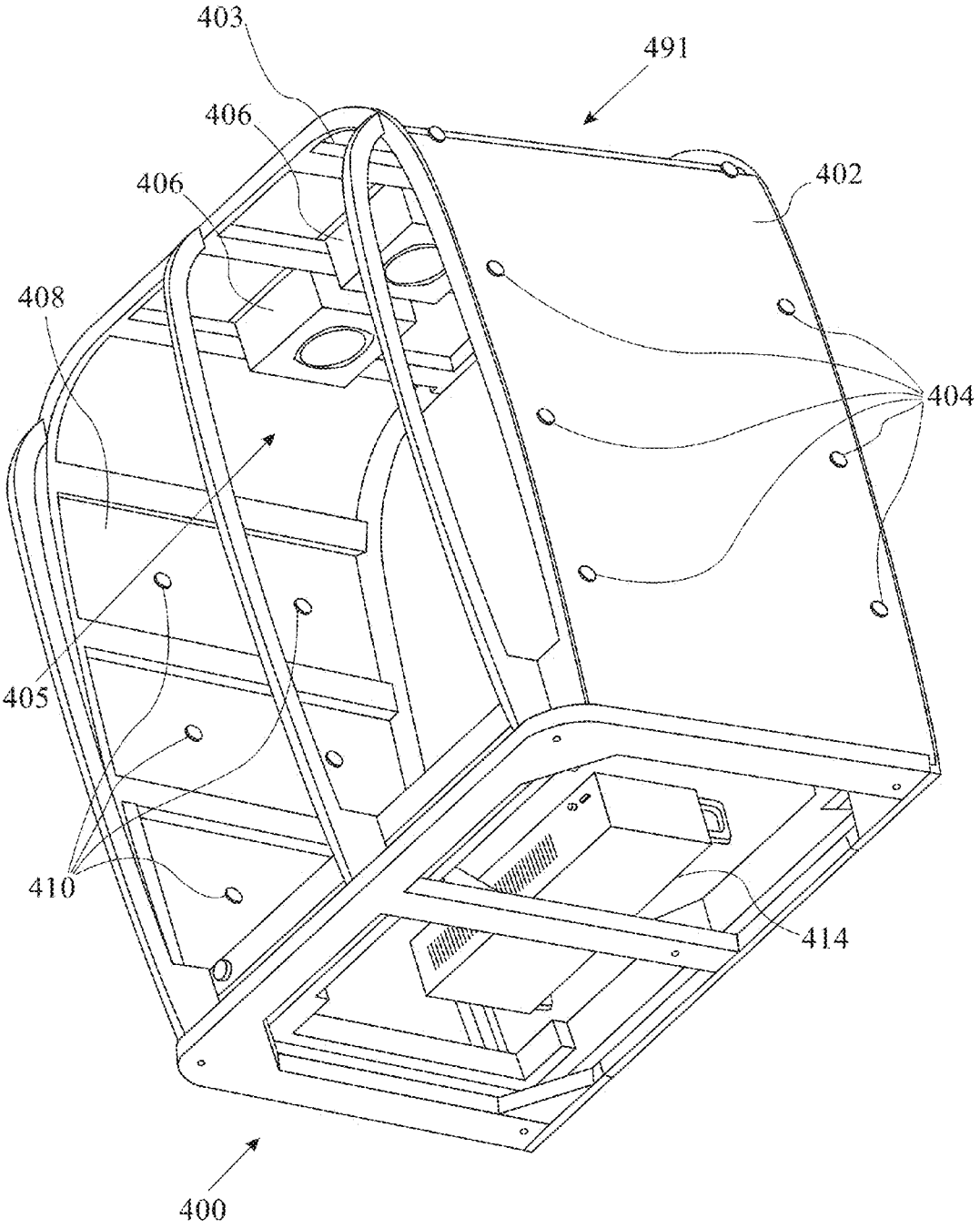
FIG. 4 is a schematic illustration of elements of a noise control system, in accordance with some demonstrative embodiments.

Reference is made to FIG. 4, which schematically illustrates elements of a noise control system 400, in accordance with some demonstrative embodiments. For example, noise reduction system 400 perform one or more functionalities and/or operations of noise control system 100 (FIG. 1), noise control system 200 (FIG. 2) and/or noise control system 300 (FIG. 3).

In some demonstrative embodiments, noise control system 400 may include a box-like sheltering structure 491 including an external layer 402, a frame structure 403, and a passive noise reduction layer 408, e.g., as described below.

In some demonstrative embodiments, external layer 402 may be formed, for example, of a plastic material, a metallic material, a compound material, a galls material, or any other material.

In some demonstrative embodiments, noise control system 400 may include one or more first acoustic sensors 404, e.g., a plurality of acoustic sensors 404, to sense external noise at one or more respective noise sensing locations on an outer surface of the sheltering structure 491, e.g., on a surface of layer 402.

In some demonstrative embodiments, as shown in FIG. 4, noise control system 400 may include a plurality of acoustic sensors 404 distributed to sense the external noise at a respective plurality of different locations on the outer surface of layer 402.

In some demonstrative embodiments, one or more of acoustic sensors 404, e.g., some or all of acoustic sensors 404, may be embedded within the outer surface of the sheltering structure 491, e.g., embedded within or under layer 402.

In some demonstrative embodiments, one or more of reference microphones 404 may be connected to the outer surface of external layer 402, and/or embedded within external layer 402.

In some demonstrative embodiments, frame structure 403 may be configured to support external layer 402 and to define an internal volume 405 to house one or more acoustic transducers, for example, one or more speakers 406.

In some demonstrative embodiments, the one or more speakers 406 may include one or more speakers (also referred to as "ANR speakers") to generate one or more noise control acoustic signals; and/or one or more private audio speakers, for example, to generate acoustic signals of private audio, e.g., as described above.

In some demonstrative embodiments, one or more of the speakers 406 may be controlled to generate a combination of the noise control acoustic signals and the acoustic signals of private audio, e.g., as described above.

In some demonstrative embodiments, structure 403 may be configured to support speakers 406, external layer 402, and/or passive noise reduction layer 408.

In some demonstrative embodiments, structure 403 may include a two-dimensional or three-dimensional truss structure, which may include a plurality of openings, which may be configured to enable audio signals to travel from speakers 406 to the noise controlled volume within the sheltering structure 491.

In some demonstrative embodiments, passive noise-reduction layer 408 may be formed of a material configured to passively block and/or absorb at least one predefined spectrum of external noise external to the noise controlled volume. For example, passive noise-reduction layer 408 may be formed of a material configured to block and/or absorb audio signals of high frequencies.

In some demonstrative embodiments, noise control system 400 may include one or more acoustic sensors 410 ("error microphones") to sense residual noise at one or more respective residual noise sensing locations on an inner surface of the sheltering structure 491, e.g., an inner surface of layer 408, as shown in FIG. 4.

In some demonstrative embodiments, as shown in FIG. 4, noise control system 400 may include a plurality of acoustic sensors 410 distributed to sense the residual noise at a respective plurality of different locations on the inner surface of layer 408.

In some demonstrative embodiments, one or more of acoustic sensors 410 may be embedded within the inner surface of the sheltering structure 491. For example, one or more of acoustic sensors 410 may be located on, connected to, or embedded within, passive noise-reduction layer 408, and/or any other portion of the sheltering structure 491.

In some demonstrative embodiments, as shown in FIG. 4, one or more of acoustic sensors 404 may be on a first side of passive noise reduction layer 408, and one or more of acoustic sensors 410 may be on a second side, opposite to the first side, of the passive noise reduction layer 408.

In some demonstrative embodiments, noise control system 400 may include a controller component 414 configured to control acoustic signals to be generated by the one or more acoustic transducers 406, e.g., as described below.

In some demonstrative embodiments, controller component 414 may include may include circuitry and/or logic, for example, one or more processors including circuitry and/or logic, memory circuitry and/or logic, ANC circuitry and/or logic, ANR circuitry and/or logic, and/or any other circuitry and/or logic, configured to perform the functionality of controller 414. Additionally or alternatively, one or more functionalities of controller 414 may be implemented by logic, which may be executed by a machine and/or one or more processors, e.g., as described below. In one example, controller component 414 may include, or may be implemented as part of an integrated circuit, for example, a System on Chip (SIC).

In some demonstrative embodiments, controller component 414 may be connected to, or embedded within one or more elements of the sheltering structure 491.

In some demonstrative embodiments, controller component 414 be configured to determine a noise control pattern based at least on one or more noise inputs from acoustic sensors 404 and/or one or more noise inputs from acoustic sensors 410, e.g., as described below.

In some demonstrative embodiments, controller component 414 may be configured to generate one or more control signals to control acoustic signals generated by the one or more acoustic transducers 406 based on the noise control pattern.

In some demonstrative embodiments, controller component 414 may be configured to perform one or more of the functionalities and/or operations described above with respect to controller component 314 (FIG. 3).

Figure 5:
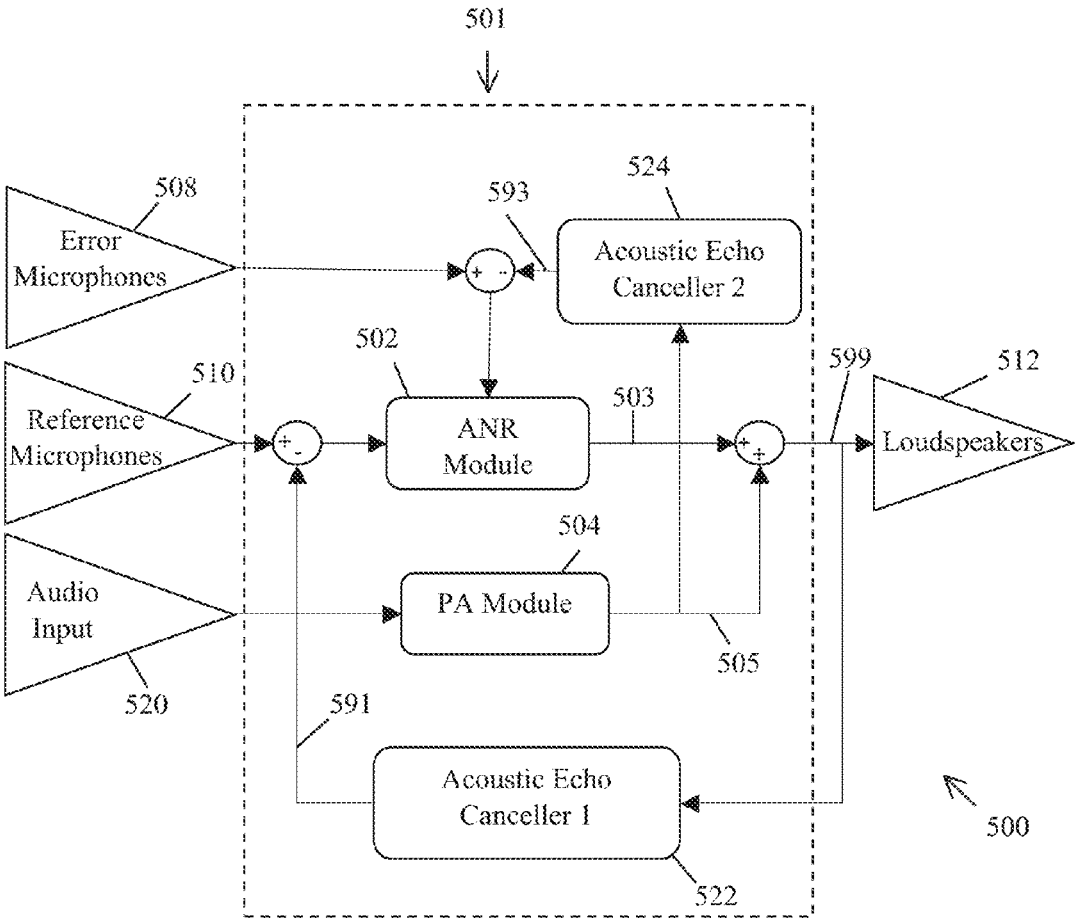
FIG. 5 is a schematic illustration of an acoustic control system, in accordance with some demonstrative embodiments.

Reference is made to FIG. 5, which schematically illustrates an acoustic control system 500, in accordance with some demonstrative embodiments.

In some demonstrative embodiments, system 500 may be configured to combine between a noise cancellation operation of an ANR system and audio signals of a private audio functionality, e.g., as described below.

For example, system 500 may be implemented as part of noise control system 100 (FIG. 1), noise control system 200 (FIG. 2), noise control system 300 (FIG. 3), and/or noise reduction system 400 (FIG. 4).

In some demonstrative embodiments, system 500 may include an ANR module 502, which may be configured to generate a noise cancellation signal 503 corresponding to a noise cancellation pattern, which may be configured to control one or more speakers 512 to generate a noise cancellation signal for active noise control, for example, based on input signals received from one or more reference microphones 510, and one or more input signals received from one or more error microphones 508, e.g., as described below. For example, error microphones 508 may perform the functionality of error microphones 310 (FIG. 3), reference microphones 510 may perform the functionality of reference microphones 304 (FIG. 3), and/or speakers 512 may perform the functionality of speakers 306 (FIG. 3).

In some demonstrative embodiments, system 500 may include a private audio (PA) Module 504 configured to generate one or more speaker control signals 505 to control speakers 512, for example, based on one or more input signals from one or more audio inputs 520.

In one example, audio inputs 520 may include an audio port to be connected to one or more audio sources, via a wired and/or wireless connection. The audio sources may include, for example, a computing device, a Smartphone, a video source device, a network interface, a storage device, an Audio source device, and/or any other device. For example, audio input interface 393 (FIG. 3) may be configured to provide audio inputs 520.

In some demonstrative embodiments, PA module 504 may receive a single channel sound input from audio input port 520. According to these embodiments, PA module 504 may compute audio signals 505 to be provided to each speaker 512, for example, such that a sound beam generated by the speakers 512 based on signals 512 may be hearable only within the noise-controlled zone, e.g., as described above.

As shown in FIG. 5, in some demonstrative embodiments, PA module 504 and ANR module 502 may share speakers 512. For example, as shown in FIG. 5, signals 503 and 505 may be combined into input signals to be provided to speakers 512. In other embodiments, PA module 504 and ANR module 502 may use separate speakers 512.

In some demonstrative embodiments, system 500 may include an echo processing component ("Acoustic Echo Canceller") 522 configured to reduce, remove, and/or cancel, partially or entirely, a portion of the signal generated by the loudspeakers 512 from an output signal of the reference microphones 510.

In some demonstrative embodiments, echo-processing component 522 may be configured to determine a processed noise reduction pattern 591 by applying to the noise reduction pattern to be provided to speakers 512 a function, which is based on one or more paths between the acoustic sensors 510 and the one or more acoustic transducers 512. For example, ANR module 502 may be configured to determine the noise reduction pattern 599 based on a difference between one or more noise inputs from reference microphones 510 and the processed noise reduction pattern 591.

In some demonstrative embodiments, system 500 may include an echo processing component ("Acoustic Echo Canceller") 524 configured to remove from an output signal 508 of the error microphones 508 a portion of the signals 505 generated by PA module 504.

In some demonstrative embodiments, acoustic echo canceller 524 may be configured to determine a processed audio pattern 593 by applying to the input audio pattern 505 provided by PA module 505 a function, which is based on one or more paths between the one or more acoustic sensors 508 and the one or more acoustic transducers 512. For example, ANR module 502 may be configured to determine the noise reduction pattern of signal 503 based on a difference between the one or more noise inputs from error microphones 508 and the processed audio pattern 593.

In some demonstrative embodiments, a controller component, for example, controller component 314 (FIG. 3) and/or controller component 414 (FIG. 4) may be configured to perform one or more operations of a controller 501, e.g., including ANR module 502, PA module 504, and/or echo-processing components 522 and/or 524.

Figure 6:
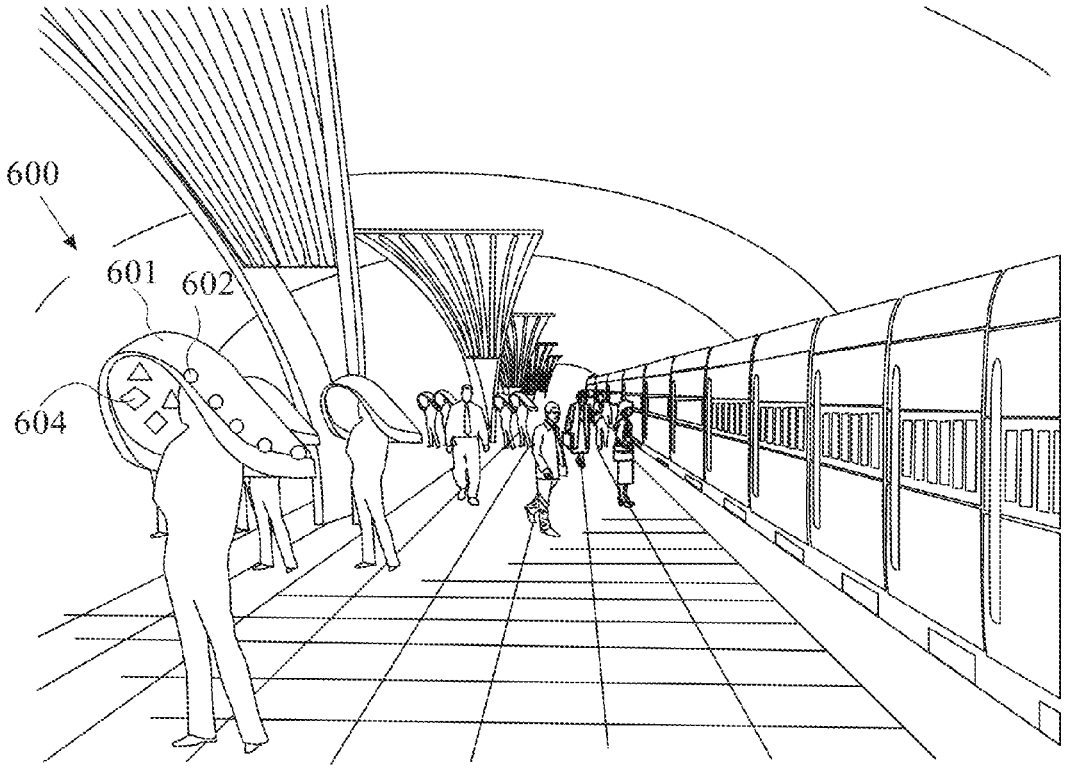
FIG. 6 is a schematic illustration of a noise control system configured for deployment at a metro station, in accordance with some demonstrative embodiments.

Reference is made to FIG. 6, which illustrates a noise control system 600 configured for deployment at a metro station, in accordance with some demonstrative embodiments.

In some demonstrative embodiments, noise control system 600 may perform one or more operations and/or functionalities of noise control system 100 (FIG. 1), noise control system 200 (FIG. 2), noise control system 300 (FIG. 3), and/or noise control system 400 (FIG. 4). In some demonstrative embodiments, noise control system 600 may include one or more elements of acoustic control system 500 (FIG. 4).

In some demonstrative embodiments, one or more attributes of noise control system 600 may be configured based on a location at which noise control system 600 may be positioned.

For example, as shown in FIG. 6, a plurality of reference microphones 602 may be located on an external side of a shell structure 601, for example, on a surface directed to a railway, such that, for example, the noise generated by a train may be captured by the reference microphones 602, e.g., before the noise hits the ears of a user occupying shell structure 601.

For example, as shown in FIG. 6, a plurality of loudspeakers 604 may be located on a side of the shell structure 601, e.g., behind a passive material layer, e.g., layer 302 (FIG. 3). The loudspeakers 604 may be configured to face towards the comfort zone within shell structure 601.

In some demonstrative embodiments, a plurality of error microphones may be located in an inner part of the comfort shell, and directed to sense the residual noise in the comfort zone.

Figure 7:
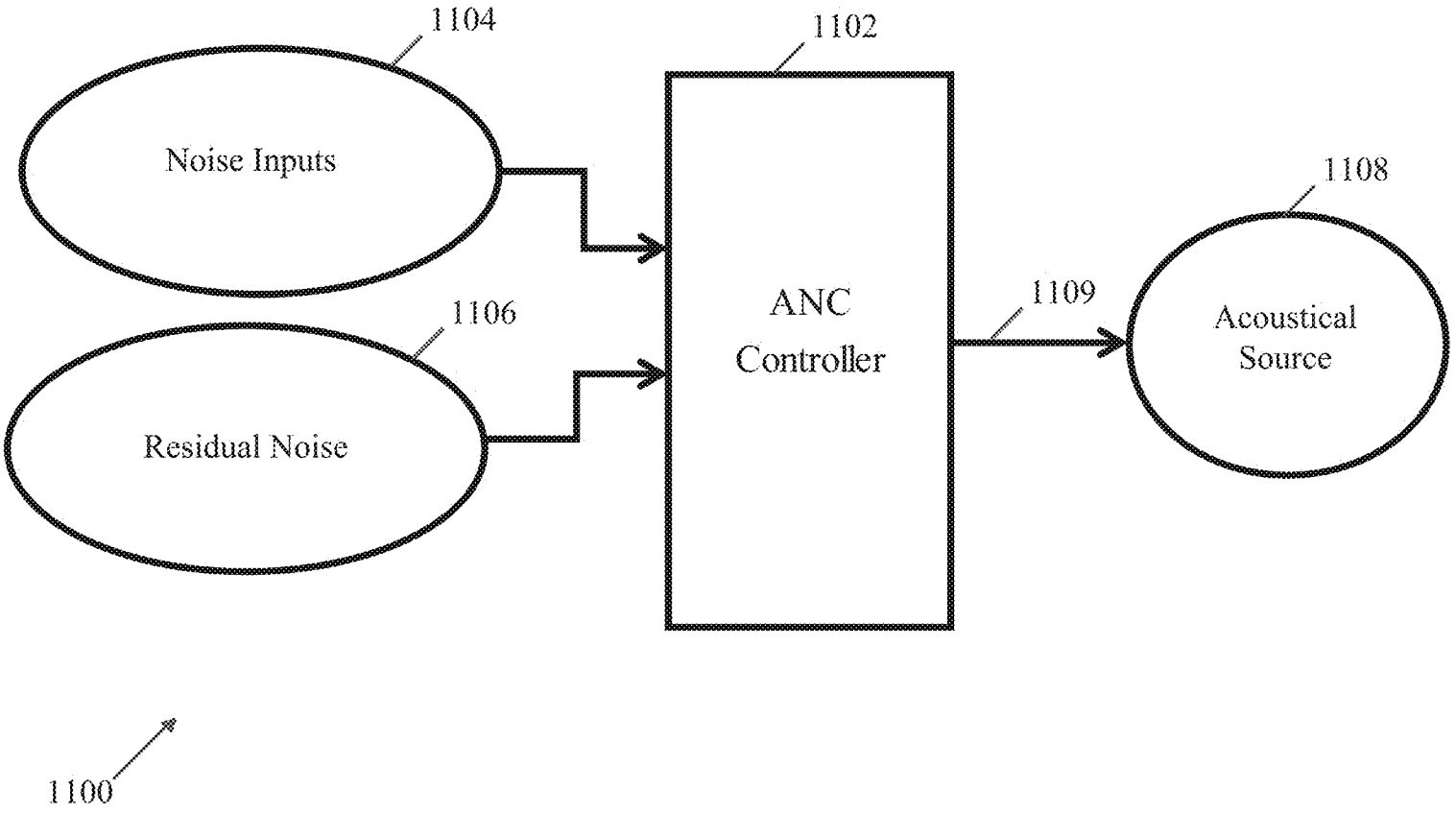
FIG. 7 is a schematic illustration of an Active Noise Control (ANC) system, in accordance with some demonstrative embodiments.
Figure 8:
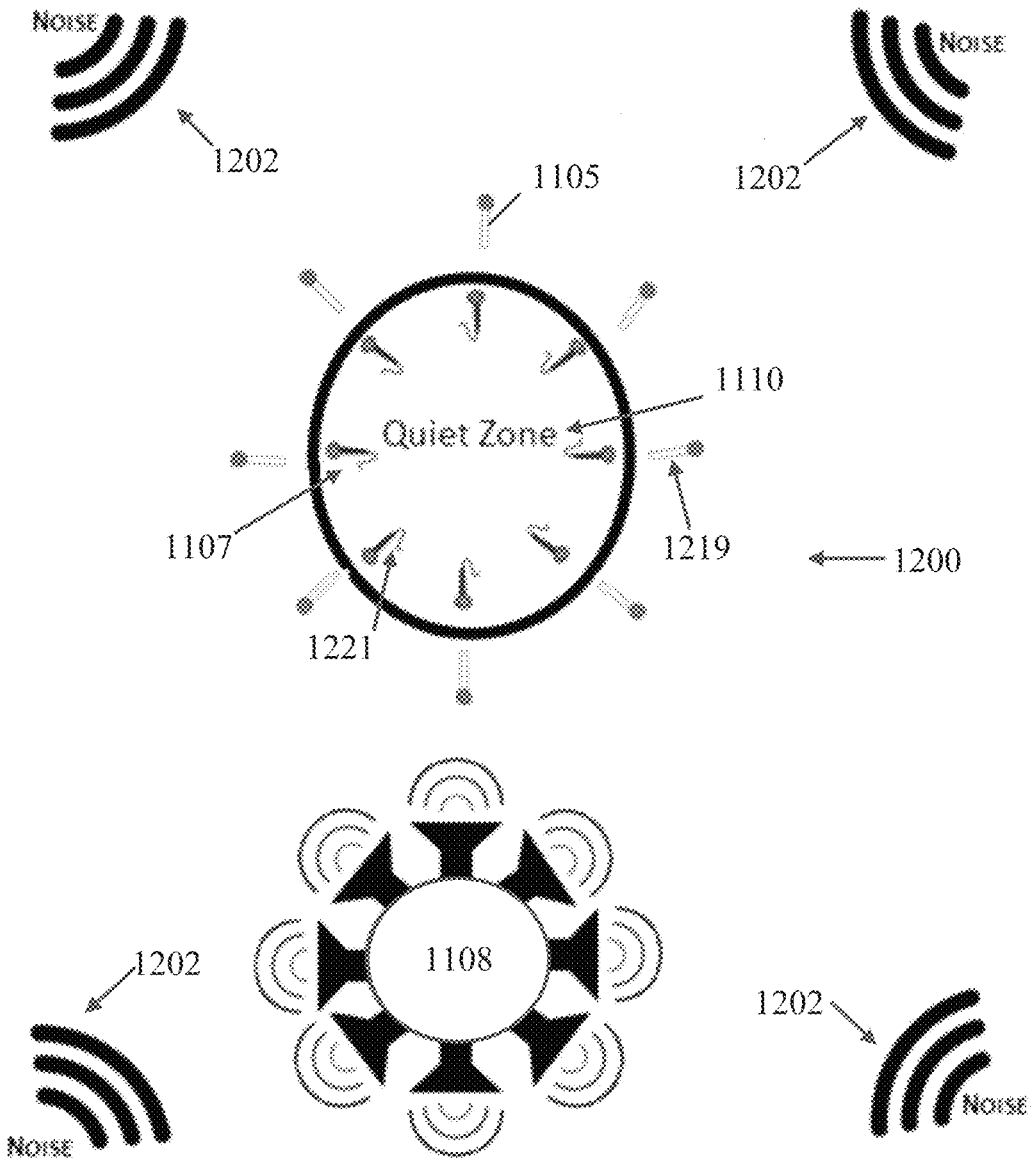
FIG. 8 is a schematic illustration of a deployment of components of an ANC to control noise within a noise-controlled volume, in accordance with some demonstrative embodiments.

Reference is now made to FIG. 7, which schematically illustrates an ANC system 1100, in accordance with some demonstrative embodiments. Reference is also made to FIG. 8, which schematically illustrates a deployment scheme 1200 of components of ANC system 1100, in accordance with some demonstrative embodiments. For example, one or more elements of noise control system 100 (FIG. 1), one or more elements of noise control system 200 (FIG. 2), one or more elements of noise control system 300 (FIG. 3), one or more elements of noise control system 400 (FIG. 4), and/or one or more elements of noise control system 600 (FIG. 6) may include, operate as, and/or perform one or more functionalities of ANC system 1100.

In some demonstrative embodiments, ANC system 1100 may include a controller 1102 to control noise within a predefined noise-control zone 1110, e.g., as described in detail below. For example, noise-control zone 1110 may include the noise-controlled volume 104 (FIG. 1) within sheltering structure 102 (FIG. 1), the noise-controlled volume within sheltering structure 391 (FIG. 3), and/or the noise-controlled volume within sheltering structure 491 (FIG. 4). For example, controller 1102 (FIG. 1) may perform one or more operations and/or functionalities of controller 314 (FIG. 3), controller 414 (FIG. 4) and/or controller 501 (FIG. 5).

In some demonstrative embodiments, noise control zone 1110 may include a three-dimensional zone. For example, noise control zone 1110 may include a spherical zone, a cubical zone, a box-shaped zone, and/or a zone of any other shape.

In some demonstrative embodiments, controller 1102 may be configured to receive a plurality of noise inputs 1104 representing acoustic noise at a plurality of predefined noise sensing locations 1105, which are defined with respect to noise-control zone 1110.

In some demonstrative embodiments, controller 1102 may receive noise inputs 1104 from one or more acoustic sensors, e.g., microphones, accelerometers, tachometers and the like, located at one or more of locations 1105, and/or from one or more virtual sensors configured to estimate the acoustic noise at one or more of locations 1105, e.g., as described in detail below.

In some demonstrative embodiments, controller 1102 may be configured to receive a plurality of residual-noise inputs 1106 representing acoustic residual-noise at a plurality of predefined residual-noise sensing locations 1107, which are located within noise-control zone 1110.

In some demonstrative embodiments, controller 1102 may receive residual-noise inputs 1106 from one or more acoustic sensors, e.g., microphones, accelerometers tachometers and the like, located at one or more of locations 1107, and/or from one or more virtual sensors configured to estimate the residual-noise at one or more of locations 1107, e.g., as described in detail below.

In some demonstrative embodiments, ANC 1100 may include at least one acoustic transducer 1108, e.g., a speaker. Controller 1102 may control acoustic transducer 108 to generate an acoustic noise control pattern configured to control the noise within noise control zone 1110, e.g., as described in detail below. For example, transducer 1108 may perform the functionality of speaker 306 (FIG. 3), speaker 406 (FIG. 4), and/or speakers 512 (FIG. 5).

In some demonstrative embodiments, controller 1102 may be configured to determine a noise control signal 1109, based on noise inputs 1104 and residual-noise inputs 1106, and to output noise control signal 1109 to control acoustic transducer 1108, e.g., as described in detail below.

In some demonstrative embodiments, the at least one acoustic transducer 1108 may include, for example, an array of one or more acoustic transducers, e.g., at least one suitable speaker, to produce the noise control pattern based on noise control signal 1109.

In some demonstrative embodiments, the at least one acoustic transducer 1108 may be positioned at one or more locations, which may be determined based on one or more attributes of noise control zone 1110, e.g., a size and/or shape of zone 1110, one or more expected attributes inputs 1104, one or more expected attributes of one or more potential actual external noise sources 1202, e.g., an expected location and/or directionality of noise sources 202 relative to noise control zone 1110, a number of external noise sources 1202, and the like.

In one example, acoustic transducer 1108 may include a speaker array including a predefined number, denoted M, of speakers or a multichannel acoustical source. For example, acoustic transducer 1108 include speaker Part No. AI 4.0, available from Cerwin-Vega Inc., Chatsworth, Calif., and/or any other speaker and/or acoustic transducer.

In some demonstrative embodiments, acoustic transducer 1108 may include an array of speakers implemented using a suitable "compact acoustical source" positioned at a suitable location, e.g., external to zone 1110. In another example, the array of speakers may be implemented using a plurality of speakers distributed in space, e.g., around noise control zone 1110.

In some demonstrative embodiments, locations 1105 may be distributed externally to noise control zone 1110. For example, one or more of locations 1105 may be distributed on, or in proximity to, an envelope or enclosure surrounding noise control zone 110, for example, on the external or outer surface of sheltering structure 102 (FIG. 1), e.g., on external layer 302 (FIG. 3).

In some demonstrative embodiments, locations 1107 may be distributed within noise control zone 1110, for example, in proximity to the envelope of noise control zone 1110.

In some demonstrative embodiments, for example, quiet zone 1110 may be defined by a spherical volume, and locations 107 may be distributed on a spherical surface having a radius, which is equal to or lesser than a radius of noise control zone 1110.

In some demonstrative embodiments, ANC system 1100 may include one or more first acoustic sensors ("primary sensors"), e.g., microphones 310 (FIG. 3), microphones 410 (FIG. 4) and/or microphones 510 (FIG. 5), to sense the acoustic noise at one or more of the plurality of noise sensing locations 1105.

In some demonstrative embodiments, ANC system 1100 may include one or more second acoustic sensors ("error sensors"), e.g., microphones 304 (FIG. 3), microphones 404 (FIG. 4), and/or microphones 508 (FIG. 5), to sense the acoustic residual-noise at one or more of the plurality of residual-noise sensing locations 1107.

In some demonstrative embodiments, one or more of the error sensors and/or one or more of the primary sensors may be implemented using one or more "virtual sensors" ("virtual microphones"). A virtual microphone corresponding to a particular microphone location may be implemented by any suitable algorithm and/or method capable of evaluating an acoustic pattern, which would have be sensed by an actual acoustic sensor located at the particular microphone location.

In some demonstrative embodiments, controller 1102 may be configured to simulate and/or perform the functionality of the virtual microphone, e.g., by estimating and/or evaluating the acoustic noise pattern at the particular location of the virtual microphone.

In some demonstrative embodiments, ANC system 1100 may include a first array 1219 of one or more primary sensors, e.g., microphones, accelerometers, tachometers and the like, for example, acoustic sensors 304 (FIG. 3), acoustic sensors 404 (FIG. 4), and/or microphones 510 (FIG. 5), configured to sense the primary patterns at one or more of locations 1105. For example, the primary sensors may include one or more sensors to sense the primary patterns on a spherical surface defining a spherical noise control zone 1110.

For example, array 1219 may include microphone Part No. ECM6AP, available from ARIO Electronics Co. Ltd., Taoyuan, Taiwan, or any other microphone or microphone array. The microphone may output a noise signal 1104 including, for example, a sequence of N samples per second. For example, N may be 41100 samples per second, e.g., if the microphone operates at a sampling rate of about 44.1 KHz. The noise signal 1104 may include any other suitable signal having any other suitable sampling rate and/or any other suitable attributes.

In some demonstrative embodiments, one or more of the sensors of array 1219 may be implemented using one or more "virtual sensors". For example, array 1219 may be implemented by a combination of at least one microphone and at least one virtual microphone. A virtual microphone corresponding to a particular microphone location of locations 1105 may be implemented by any suitable algorithm and/or method, e.g., as part of controller 1102 or any other element of system 1100, capable of evaluating an acoustic pattern, which would have be sensed by an acoustic sensor located at the particular microphone location. For example, controller 1102 may be configured to evaluate the acoustic pattern of the virtual microphone based on at least one actual acoustic pattern sensed by the at least one microphone of array 1219.

In some demonstrative embodiments, ANC system 1100 may include a second array 1221 of one or more error sensors, e.g., microphones, for example, acoustic sensors 310 (FIG. 3), acoustic sensors 410 (FIG. 4), and/or microphones 508 (FIG. 5), configured to sense the acoustic residual-noise at one or more of locations 1107. For example, the error sensors may include one or more sensors to sense the acoustic residual-noise patterns on a spherical surface within spherical noise control zone 1110.

In some demonstrative embodiments, one or more of the sensors of array 1221 may be implemented using one or more "virtual sensors". For example, array 1221 may include a combination of at least one microphone and at least one virtual microphone. A virtual microphone corresponding to a particular microphone location of locations 1107 may be implemented by any suitable algorithm and/or method, e.g., as part of controller 1102 or any other element of system 1100, capable of evaluating an acoustic pattern, which would have be sensed by an acoustic sensor located at the particular microphone location. For example, controller 1102 may be configured to evaluate the acoustic pattern of the virtual microphone based on at least one actual acoustic pattern sensed by the at least one microphone of array 1221.

In some demonstrative embodiments, the number, location and/or distribution of the locations 1105 and/or 1107, and/or the number, location and/or distribution of one or more acoustic sensors at one or more of locations 1105 and 1107 may be determined based on a size of noise control zone 1110 or of an envelope of noise control zone 1110, a shape of noise control zone 1110 or of the envelope of noise control zone 1110, one or more attributes of the acoustic sensors to be located at one or more of locations 1105 and/or 1107, e.g., a sampling rate of the sensors, and the like.

In one example, one or more acoustic sensors, e.g., microphones, accelerometers, tachometers and the like, may be deployed at locations 1105 and/or 1107 according to the Spatial Sampling Theorem, e.g., as defined below by Equation 1.

For example, a number of the primary sensors, a distance between the primary sensors, a number of the error sensors and/or a distance between the error sensors may be determined in accordance with the Spatial Sampling Theorem, e.g., as defined below by Equation 1.

In one example, the primary sensors and/or the error sensors may be distributed, e.g., equally distributed, with a distance, denoted d, from one another. For example, the distance d may be determined as follows:

$$d \leq \frac{c}{2 \cdot f} \tag{1}$$

wherein c denotes the speed of sound and $f_{max}$ denotes a maximal frequency at which noise control is desired.

For example, in case the maximal frequency of interest is $f_{max}$=100 [Hz], the distance d may be determined as $$d \leq \frac{343}{2 \cdot 100} = 1.71[m].$$

As shown in FIG. 8 deployment scheme 1200 is configured with respect to a circular or spherical noise control zone 1110. For example, locations 1105 are distributed, e.g., substantially evenly distributed, in a spherical or circular manner around noise control zone 1110, and locations 1107 are distributed, e.g., substantially evenly distributed, in a spherical or circular manner within noise control zone 1110.

However in other embodiments, components of ANC system 1100 may be deployed according to any other deployment scheme including any suitable distribution of locations 1105 and/or 1107, e.g., configured with respect a noise control zone of any other suitable form and/or shape, for example, based on one or more characteristics of a location at which noise control system 100 (FIG. 1), noise control system 20 (FIG. 2), noise control system 300 (FIG. 3), noise control system 400 (FIG. 4), and/or noise control system 600 (FIG. 6), is to be deployed, e.g., as described above.

In some demonstrative embodiments, controller 1102 may be configured to determine the noise control pattern to be reduced according to at least one noise parameter, e.g., energy, amplitude, phase, frequency, direction, and/or statistical properties within noise-control zone 1110, e.g., as described in detail below.

In some demonstrative embodiments, controller 1102 may determine the noise control pattern to selectively reduce one or more predefined first noise patterns within noise-control zone 1110, while not reducing one or more second noise patterns within noise-control zone 1110, e.g., as described below.

In one demonstrative embodiment, noise reduction system 100 (FIG. 1) may be located in a street, and controller 1102 may determine the noise control pattern to selectively reduce one or more first noise patterns, e.g., including a pedestrian noise pattern, a wind noise pattern, and/or a vehicle noise pattern of one or more vehicles.

In some demonstrative embodiments, controller 1102 may determine the noise control pattern without having information relating to one or more noise-source attributes of one or more of actual noise sources 1202 generating the acoustic noise at the noise sensing locations 1105.

For example, the noise-source attributes may include a number of noise sources 1202, a location of noise sources 1202, a type of noise sources 1202 and/or one or more attributes of one or more noise patterns generated by one or more of noise sources 1202.

In some demonstrative embodiments, controller 1102 may be configured to extract from the plurality of noise inputs 1104 a plurality of disjoint reference acoustic patterns, which are statistically independent.

For example, controller 1102 may include an extractor to extract the plurality of disjoint reference acoustic patterns, e.g., as described below with reference to FIG. 10.

The phrase "disjoint acoustic patterns" as used herein may refer to a plurality of acoustic patterns, which are independent with respect to at least one feature and/or attribute, e.g., energy, amplitude, phase, frequency, direction, one or more statistical signal properties, and the like.

In some demonstrative embodiments, controller 1102 may extract the plurality of disjoint reference acoustic patterns by applying a predefined extraction function to the plurality of noise inputs 1104, e.g., as described below with reference to FIG. 10.

In some demonstrative embodiments, the extraction of the disjoint acoustic patterns may be used, for example, to model the primary pattern of inputs 1104 as a combination of the predefined number of disjoint acoustic patterns, e.g., corresponding to a respective number of disjoint modeled acoustic sources.

This modeling may be useful, for example, in order to increase an efficiency, e.g., a computational efficiency, reduce a complexity, e.g., a mathematical and/or computational complexity, which may result from processing the primary pattern, without, having, for example, a-priori information regarding the primary pattern and/or the one or more actual noise sources 1202, for example, a predefined noise pattern of a train, e.g., if noise control system 100 (FIG. 1), noise control system 20 (FIG. 2), noise control system 300

(FIG. 3), noise control system 400 (FIG. 4), and/or noise control system 600 (FIG. 6) is to be placed at a train station.

Additionally or alternatively, the extraction of the disjoint acoustic patterns may enable selectively controlling noise within noise control zone 1110, e.g., according to one or more predefined noise attributes and/or types, e.g., as described below.

In some demonstrative embodiments, controller 1102 may determine the noise control signal 1109 for generating the noise control pattern based on at least one disjoint reference acoustic pattern of the plurality of disjoint reference acoustic patterns.

In some demonstrative embodiments, controller 1102 may select the at least one disjoint reference acoustic pattern ("the selected reference acoustic pattern") from the plurality of disjoint reference acoustic patterns based, for example, on one or more predefined acoustic pattern attributes of at least one predefined noise pattern to be controlled within noise-control zone 1110.

In some demonstrative embodiments, the acoustic pattern attributes may include an amplitude, energy, phase, frequency, direction, and/or one or more statistical signal properties of the predefined noise pattern.

In some demonstrative embodiments, the predefined acoustic pattern attributes may relate to expected and/or estimated attributes of an expected noise pattern to be affecting noise control zone 1110, for example, a noise pattern of noise in a shopping mall, if noise control system 100 (FIG. 1), noise control system 20 (FIG. 2), noise control system 300 (FIG. 3), noise control system 400 (FIG. 4), and/or noise control system 600 (FIG. 6) is to be placed at a shopping mall.

Figure 9:
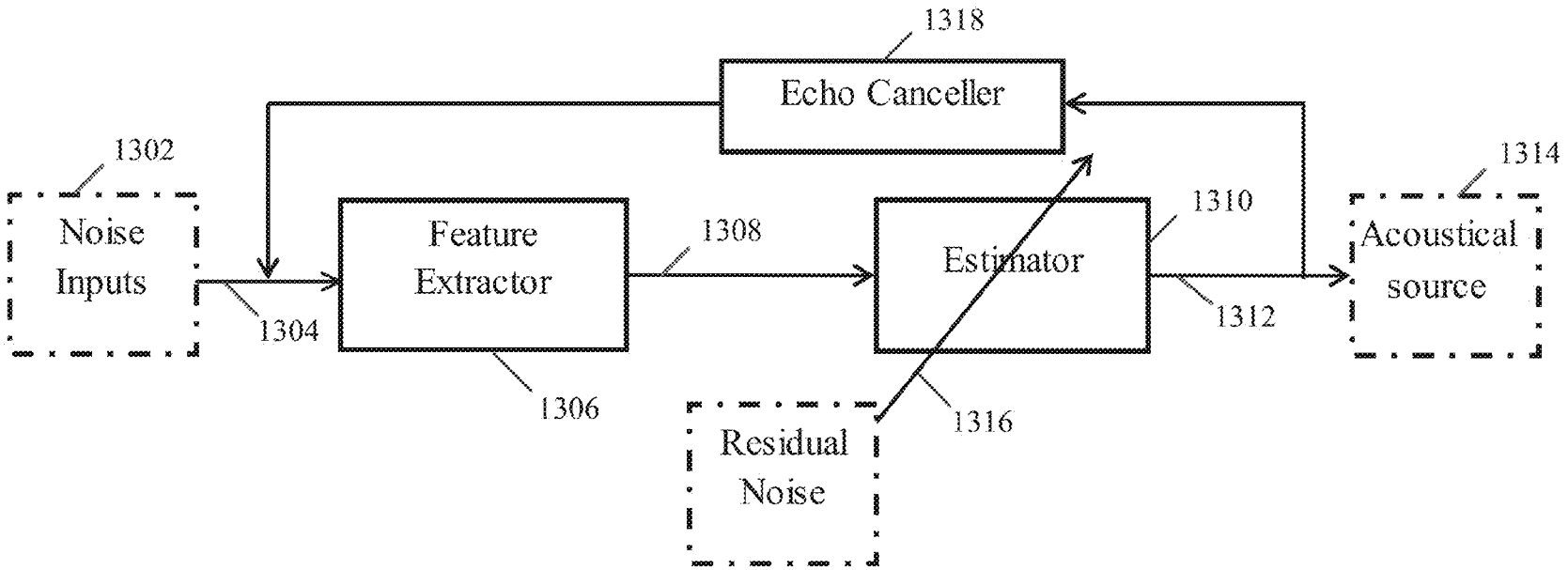
FIG. 9 is a schematic illustration of a controller component, in accordance with some demonstrative embodiments.

Reference is now made to FIG. 9, which schematically illustrates a controller component 1300, in accordance with some demonstrative embodiments. In some embodiments, controller component 1300 may be implemented to perform, for example, one or more operations and/or functionalities of controller component 314 (FIG. 3), controller component 414 (FIG. 4), controller 501 (FIG. 5), and/or controller 1102 (FIG. 6).

In some demonstrative embodiments, controller 1300 may receive a plurality of inputs 1304, e.g., including inputs 1104 (FIG. 7), representing acoustic noise at a plurality of predefined noise sensing locations, e.g., locations 1105 (FIG. 8), which are defined with respect to a noise-control zone, e.g., noise control zone 1110 (FIG. 8). Controller 1300 may generate a noise control signal 1312 to control at least one acoustic transducer 1314, e.g., acoustic transducer 1108 (FIG. 7).

In some demonstrative embodiments, controller 1300 may include an estimator ("prediction unit") 1310 to estimate noise signal 1312 by applying an estimation function to an input 1308 corresponding to inputs 1304.

In some demonstrative embodiments, e.g., as shown in FIG. 9, controller 1300 may include an extractor 1306 to extract a plurality of disjoint reference acoustic patterns from inputs 1304, e.g., as described below. According to these embodiments, input 1308 may include the plurality of disjoint reference acoustic patterns.

In some demonstrative embodiments, controller 1300 may use the extraction of the disjoint acoustic patterns to model the noise represented by inputs 1304 as a combination of a predefined number of disjoint modeled acoustic sources generating the predefined number of disjoint acoustic patterns, respectively. This modeling may be useful, for example, in order to increase an efficiency, e.g., a computational efficiency, reduce a complexity, e.g., a mathematical and/or computational complexity, of controller 1300, which may result, for example, from processing inputs 1304, without, having, for example, a-priori information regarding attributes of inputs 1304 and/or attributes of one or more noise sources generating and/or affecting inputs 1304.

Additionally or alternatively, controller 1300 may utilize the disjoint acoustic patterns 308 to reduce and/or eliminate noise within the noise control zone 1110 (FIG. 8) in a selective and/or configurable manner, e.g., based on one or more predefined noise pattern attributes.

For example, controller 1300 may be configured to generate noise control signal 1312 based on the disjoint acoustic patterns such that, for example, the noise control signal 1312 may affect the noise energy and/or wave amplitude of one or more first primary patterns in a first manner, while the noise energy and/or wave amplitude of one or more second primary patterns may be affected in a second, different manner.

In one example, controller 1300 may generate noise control signal 1312 configured to reduce and/or eliminate the noise energy and/or wave amplitude of the first primary patterns within the noise control zone, while the noise energy and/or wave amplitude of the first primary patterns may not be affected within the noise control zone.

In some demonstrative embodiments, extractor 1306 may be configured to extract noise patterns related to one or more "unwanted" noise sources and/or patterns, which may be predefined based on any suitable attributes. Controller 1300 may generate noise control signal 1312 such that, for example, only a specific portion of the unwanted noise will be destructed by the pattern produced by the transducer 1314.

Figure 10:
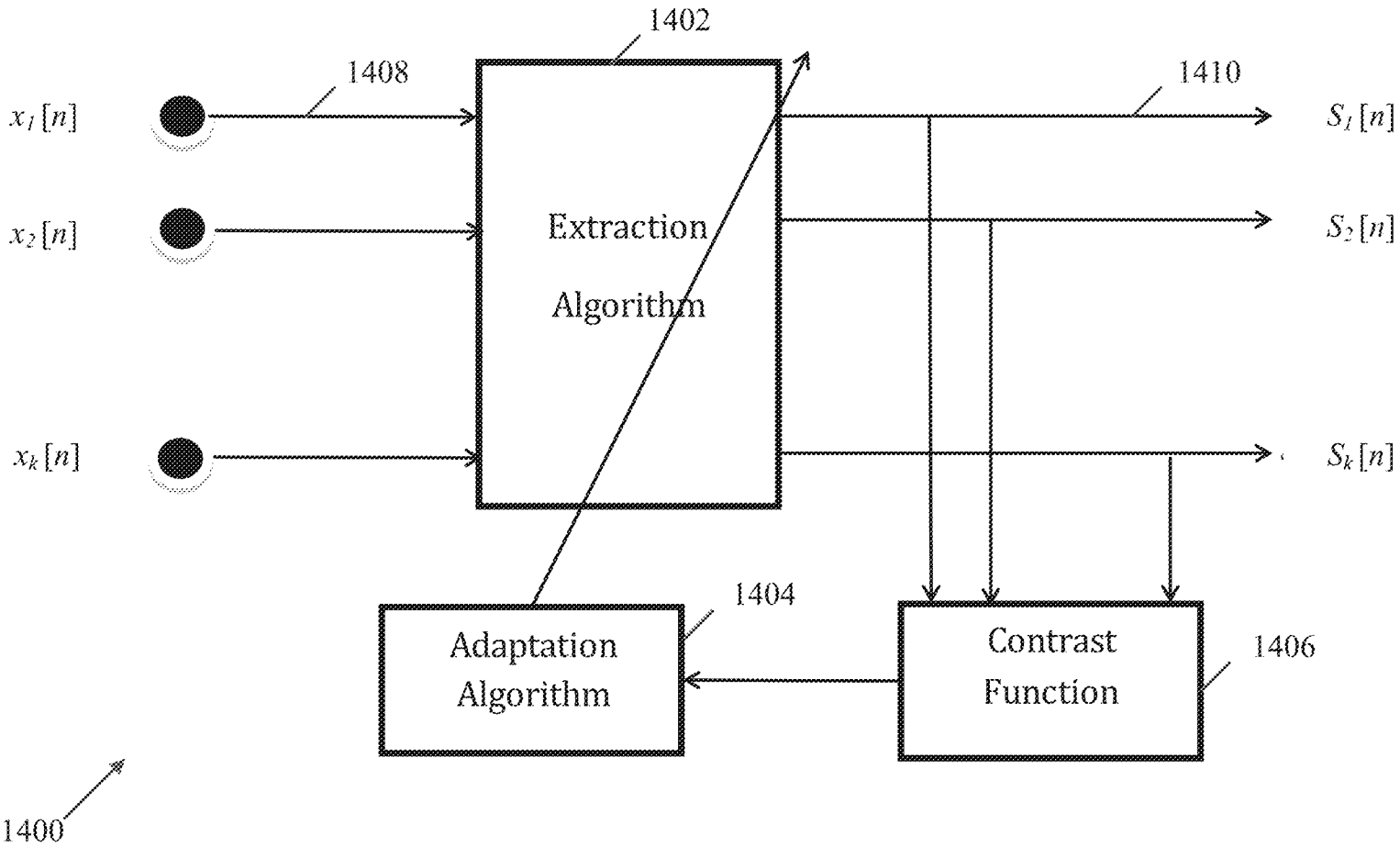
FIG. 10 is a schematic illustration of an extractor component, in accordance with some demonstrative embodiments.

Reference is now made to FIG. 10, which schematically illustrates an extractor component 1400, in accordance with some demonstrative embodiments. In some demonstrative embodiments, extractor 1400 may perform one or more operations and/or functionalities of extractor 1306 (FIG. 8).

In some demonstrative embodiments, extractor 1400 may receive a plurality of inputs 1408, e.g., including inputs 1104 (FIG. 7), representing acoustic noise at a plurality of predefined noise sensing locations, e.g., locations 1105 (FIG. 8), which are defined with respect to a noise-control zone, e.g., noise control zone 1110 (FIG. 8). Extractor 1400 may extract from inputs 1408 a plurality of disjoint reference acoustic patterns 1410, e.g., as described in detail below.

In some demonstrative embodiments, extractor 1400 may apply an extraction algorithm 1402 to inputs 1408.

In some demonstrative embodiments, extraction algorithm 1402 may represent, for example, noise sources disaggregated by a suitable statistical approach, e.g., Independent Component Analysis (ICA) also known in the art as Blind Source Separation (BSS), and the like.

In some demonstrative embodiments, extractor 1400 may include an adaptation algorithm 1404 to adapt one or more parameters of extraction algorithm 1402, e.g., based on at least one predetermined criterion. For example, adaptation algorithm 1404 may be able to minimize, a statistical dependence between disjoint reference acoustic patterns 1410, e.g., Mutual Information (MI), as discussed below.

In some demonstrative embodiments, the plurality of inputs 1408 may include a predefined number, denoted K', of inputs corresponding to a respective plurality of K' noise sensing locations, e.g., locations 1105 (FIG. 8).

In some demonstrative embodiments, extraction algorithm 1402 may generate disjoint reference acoustic patterns 1410 including a predefined number, denoted K, of disjoint reference acoustic patterns 1410.

In some demonstrative embodiments, extraction algorithm 1402 may determine the K disjoint reference acoustic patterns 1410 corresponding to a current sample of the noise at the K' noise sensing locations.

In some demonstrative embodiments, extraction algorithm 1402 may determine the K disjoint reference acoustic patterns 1410 corresponding to the current sample, based on the current sample of the noise at the K' noise sensing locations, and taking into account one or more successive previous samples of the noise at the K' noise sensing locations, e.g., a predefined number, denoted I, of the noise at the K' noise sensing locations.

For example, inputs 1408 corresponding to an n-th sample, may be represented by a matrix, denoted X[n], which includes the n-th sample of the noise at the K' noise sensing locations, and I successive previous samples of the noise at the K' noise sensing locations. For example, inputs 1408 may be represented as follows:

$$X[n] = \begin{pmatrix} x_1[n] & \dots & x_1[n-I] \\ \vdots & \ddots & \vdots \\ x_{K'}[n] & \dots & x_{K'}[n-I] \end{pmatrix} \tag{2}$$

In some demonstrative embodiments, extraction algorithm 1402 may generate disjoint reference acoustic patterns 1410, by applying an extraction function to the inputs 1408, e.g. as follows:

$$\hat{S}[n]=F^{-1}(X[n]) \tag{3}$$

wherein $F^{-1}$ denotes the extraction function, and wherein $\hat{S}[n]$ denotes a vector of the K disjoint reference acoustic patterns 1410 corresponding to the n-th sample. For example, the vector $\hat{S}[n]$ may be represented as follows:

$$S[n] = \begin{pmatrix} s_1[n] \\ \vdots \\ s_K[n] \end{pmatrix} \tag{4}$$

In some demonstrative embodiments, the function $F^{-1}$ may include a memory-less function, e.g., with respect to previous samples, or a function having an element of memory.

For example, the vector $\hat{S}[n]$ may be represented as follows, e.g., using a memoryless function:

$$\hat{S}[n] = F^{-1}\begin{pmatrix} x_1[n] \\ \vdots \\ x_K[n] \end{pmatrix} \tag{5}$$

The vector $\hat{S}[n]$ may be represented, for example, as follows, e.g., using a function with memory:

$$\hat{S}[n] = F^{-1}\begin{pmatrix} x_1[n], & x_1[n-1], & x_1[n-2], \dots \\ \vdots & \vdots & \vdots \\ x_K[n], & x_K[n-1], & x_K[n-2], \dots \end{pmatrix} \tag{6}$$

In some demonstrative embodiments, the function $F^{-1}$ may include a linear function, e.g., such that each of the elements of the vector S is a linear combination of elements of the matrix X, or a non-linear function.

For example, an i-th element of the vector $\hat{S}[n]$ may be determined, e.g., as follows:

$$s_i[n] = b_i + \sum_{k=1}^{K} a_{i,k} \cdot x_k \tag{7}$$

In some demonstrative embodiments, the function $F^{-1}$ may be defined based on one or more predefined required attributes of the K disjoint reference acoustic patterns 1410, e.g., based on the one or more predefined noise pattern attributes to be controlled within the noise control zone, as described above.

In some demonstrative embodiments, the function $F^{-1}$ may include, for example, a linear mapping function with memory. For example, the operation $F^{-1}(\bullet)$ may denote an operation of convolution, e.g., such that the vector $\hat{S}[n]$ may be determined according to Equation 3 by convolving the function with the matrix X[n].

For example, the vector $\hat{S}[n]$ may be determined by transforming Equation 3 to a Z-domain, e.g., as follows:

$$\hat{S}(z)=B(z)\cdot X(z) \tag{8}$$

wherein B(z) denotes a separation matrix.

For example, extraction algorithm 1402 may determine the vector $\hat{S}(z)$ in the z-domain based on a contrast function, denoted $\varphi[\hat{S}(z)]$. For example, the contrast function $\varphi[\hat{S}(z)]$ may be defined as a Mutual Information (MI) between the outputs $\hat{S}(z)$ of extraction algorithm 1402, e.g., as follows:

$$\phi\left[\hat{S}(Z)\right] = I(s_1, \dots, \hat{s}_k) = \sum_{k=1}^{K} H(\hat{s}_k) - H(\hat{S}) \tag{9}$$

wherein I denotes an information function, and H denotes Shannon's Entropy. The information function I(X,Y) corresponding to two variables X, Y may be defined, for example, as follows:

$$I(x, y) = \sum_{y \in Y} \sum_{x \in X} p(x, y) \log\left(\frac{p(x, y)}{p(x)p(y)}\right) \tag{10}$$

where p(x,y) denotes a joint probability distribution function of X and Y, and p(x) and p(y) denote the marginal probability distribution functions of X and Y, respectively.

For example, extractor 1400 may include a contrast function estimator 1406 to estimate the contrast function $\varphi[\hat{S}(z)]$ based on the output of extractor 1402, e.g., in accordance with Equation 9. The contrast function $\varphi[\hat{S}(z)]$ may reach a minimum, for example, when extraction/separation is achieved, for example, since the separation process may be a minimization of mutual information (contrast function) between the outputs of a separation unit. For example, adaptation algorithm 1404 may adapt the function $F^{-1}$ by detecting the minimum of the function $\varphi[\hat{S}(z)]$.

In one example, the separation matrix B(z) may be determined using a natural gradient iterative algorithm, e.g., as follows:

$$B_n(z) = \left(I - \mu \frac{\partial}{\partial B_n(z)} \phi\left[\hat{S}(z)\right]\right) B_n(z) \tag{11}$$

wherein μ denotes a learning rate, e.g., an iteration step.

Referring back to FIG. 9, in some embodiments, controller 1300 may not include extractor 1306. Accordingly, input 1308 may include inputs 1304 and/or any other input based on inputs 1304.

In some demonstrative embodiments, estimator 1310 may apply any suitable linear and/or non-linear function to input 1308. For example, the estimation function may include a non-linear estimation function, e.g., a radial basis function.

In some demonstrative embodiments, estimator 1310 may be able to adapt one or more parameters of the estimation function based on a plurality of residual-noise inputs 1316 representing acoustic residual-noise at a plurality of predefined residual-noise sensing locations, which are located within the noise-control zone. For example, inputs 1316 may include inputs 1106 (FIG. 7) representing acoustic residual-noise at residual-noise sensing locations 1107 (FIG. 8), which are located within noise-control zone 1110 (FIG. 8).

In some demonstrative embodiments, one or more of inputs 1316 may include at least one virtual microphone input corresponding to a residual noise ("noise error") sensed by at least one virtual error sensor in at least one particular residual-noise sensor location of locations 1107 (FIG. 8). For example, controller 1300 may evaluate the noise error at the particular residual-noise sensor location based on inputs 1308 and the predicted noise signal 1312, e.g., as described below.

In one example, controller 1300 may utilize a speaker transfer function to produce an estimation of a noise control pattern generated by transducer 1314, e.g., by applying the speaker transfer function to predicted noise signal 1312. Controller 1300 may also utilize a modulation transfer function to produce an estimation of the noise pattern at the particular residual-noise sensor location, e.g., by applying the modulation transfer function to the noise signal represented by input 1308. Controller 1300 may determine the estimated residual noise at the particular residual-noise sensor location, for example, by subtracting the estimation of the noise control pattern from the estimation of the noise pattern.

In some demonstrative embodiments, controller 1300 may estimate a sample ("the succeeding sample") of the noise pattern succeeding a current sample of the noise pattern, for example, based on the current sample and/or one or more previous samples of the noise pattern. Controller 1300 may provide noise control signal 1312, such that transducer 1312 may produce the noise control pattern based on the estimated succeeding sample, e.g., such that the noise control pattern may reach the particular residual-noise sensor location substantially at the same time the noise pattern reaches the same particular residual-noise sensor location.

In some demonstrative embodiments, estimator 1310 may include a multi-input-multi-output (MIMO) prediction unit configured, for example, to generate a plurality of noise control patterns corresponding to the n-th sample, e.g., including M control patterns, denoted $y_1(n) \ldots y_M(n)$, to drive a plurality of M respective acoustic transducers, e.g., based on the inputs 1308.

Figure 11:
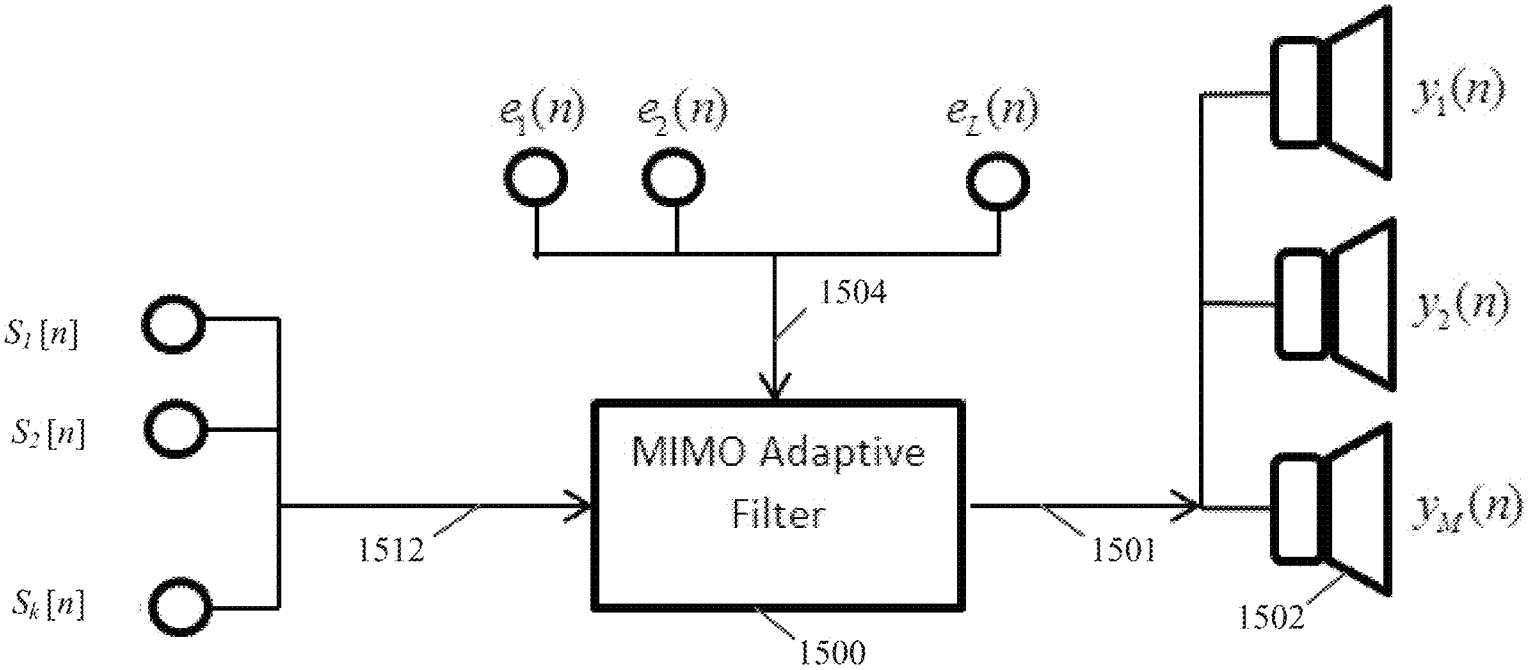
FIG. 11 is a schematic illustration of a multi-input-multi-output prediction component, in accordance with some demonstrative embodiments.

Reference is now made to FIG. 11, which schematically illustrates a MIMO prediction unit 1500, in accordance with some demonstrative embodiments. In some demonstrative embodiments, MIMO prediction unit 1500 may perform the functionality of estimator 1310 (FIG. 8).

As shown in FIG. 10, prediction unit 1500 may be configured to receive an input 1512 including the vector $\hat{S}[n]$, e.g., as output from extractor 1306 (FIG. 9), and to drive loudspeaker array 1502 including M acoustic transducers. For example, prediction unit 1500 may generate a controller output 1501 including the M noise control patterns $y_1(n) \ldots y_M(n)$, to drive a plurality of M respective acoustic transducers, e.g., based on the inputs 1308 (FIG. 9).

In some demonstrative embodiments, interference (cross-talk) between two or more of the M acoustic transducers of array 1502 may occur, for example, when two or more, e.g., all of, the M acoustic transducers generate the control noise pattern, e.g., simultaneously.

In some demonstrative embodiments, prediction unit 1500 may generate output 1501 configured to control array 1502 to generate a substantially optimal noise control pattern, e.g., while simultaneously optimizing the input signals to each speaker in array 1502. For example, prediction unit 1500 may control the multichannel speakers of array 1502, e.g., while cancelling the interface between the speakers.

In one example, prediction unit 1500 may utilize a linear function with memory. For example, prediction unit 1500 may determine a noise control pattern, denoted $y_m[n]$, corresponding to an m-th speaker of array 1502 with respect to the n-th sample of the primary pattern, e.g., as follows:

$$y_m[n] = \sum_{k=1}^{K} \sum_{i=1}^{I-1} w_{km}[i] s_k[n-i] \tag{12}$$

wherein $s_k[n]$ denotes the k-th disjoint reference acoustic pattern, e.g., received from extractor 1306 (FIG. 8), and $w_{km}[i]$ denotes a prediction filter coefficient configured to drive the m-th speaker based on the k-th disjoint reference acoustic pattern, e.g., as described below.

In another example, prediction unit 1500 may implement any other suitable prediction algorithm, e.g., linear, or non-linear, having or not having memory, and the like, to determine the output 1501.

In some demonstrative embodiments, prediction unit 1500 may optimize the prediction filter coefficients $w_{km}[i]$, for example, based on a plurality of a plurality of residual-noise inputs 1504, e.g., including a plurality of residual-noise inputs 1316. For example, prediction unit 1500 may optimize the prediction filter coefficients $w_{km}[i]$ to achieve maximal destructive interference at the residual-error sensing locations 1107 (FIG. 8). For example, locations 1107 (FIG. 8) may include L locations, and inputs 1504 may include L residual noise components, denoted $e_1[n]$, $e_2[n], \ldots, e_L[n]$.

In some demonstrative embodiments, prediction unit 1500 may optimize the prediction filter coefficients $w_{km}[i]$ based, for example, on a minimum mean square error (MMSE) criterion, or any other suitable criteria. For example, a cost function, denoted J, for optimization prediction filter coefficients $w_{km}[i]$ may be defined, for example, as a total energy of the residual noise components $e_1[n], e_2[n], \ldots, e_L[n]$ at locations 1107 (FIG. 8), e.g., as follows:

$$J = E\left\{\sum_{l=1}^{L} e_l^2[n]\right\} \tag{13}$$

In some demonstrative embodiments, a residual noise pattern, denoted $e_l[n]$, at an l-th location may be expressed, for example, as follows:

$$e_l[n] = d_l[n] - \sum_{m=1}^{M}\sum_{j=0}^{J-1} stf_{lm}[j]\cdot y_m[n-j] = d_l[n] - \sum_{m=1}^{M}\sum_{j=0}^{J-1} stf_{lmj}[j]\cdot \sum_{k=1}^{K}\sum_{i=1}^{I} w_{km}[i]s_k[n-i] \quad (14)$$

wherein $stf_{lm}[j]$ denotes a path transfer function having J coefficients from the m-th speaker of the array 1502 at a l-th location; and $w_{km}[n]$ denotes an adaptive weight vector of the prediction filter with I coefficients representing the relationship between the k-th reference acoustic pattern $s_k[n]$ and the control signal of the m-th speaker.

In some demonstrative embodiments, prediction unit 1500 may optimize the adaptive weights vector $w_{km}[n]$, e.g., to reach an optimal point, e.g., a maximal noise reduction. For example, prediction unit 1500 may implement a gradient based adaption method, when at each step the weight vector $w_{km}[n]$ is updated in a negative direction of a gradient of the cost function J, e.g., as follows:

$$w_{km}[n+1] = w_{km}[n] - \frac{\mu_{km}}{2}\cdot\nabla J_{km} \quad (15)$$

$$\nabla J_{km} = -2\sum_{l=1}^{L} e_l[n]\sum_{i=1}^{I-1} stf_{km}[n]x_k[n-i]$$

$$w_{km}[n+1] = w_{km}[n] + \mu_{km}\cdot\sum_{l=1}^{L} e_l[n]\sum_{i=1}^{I-1} stf_{km}[n]x_k[n-i]$$

Figure 12:
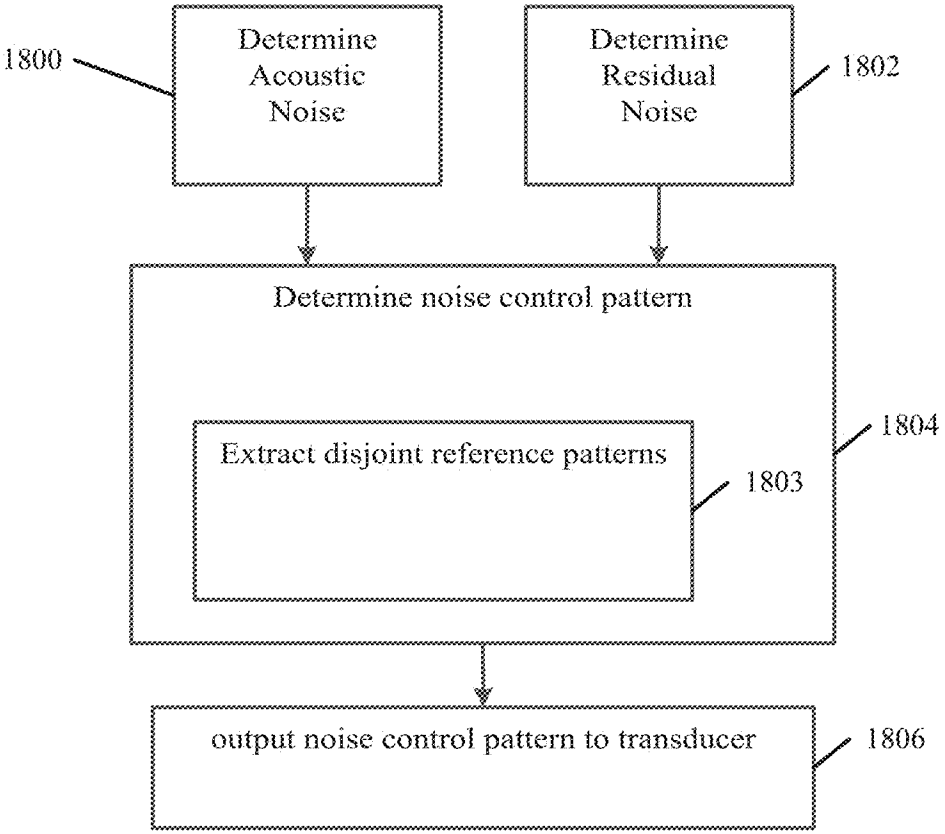
FIG. 12 is a schematic flow-chart illustration of a method of noise control, in accordance with some demonstrative embodiments.

Reference is made to FIG. 12, which is a schematic flow-chart illustration of a method of noise control, in accordance with some demonstrative embodiments. In some demonstrative embodiments, one or more operations of the method of FIG. 12 may be performed by one or more elements of a noise control system, e.g., noise control system 100 (FIG. 1), noise control system 200 (FIG. 2), noise control system 300 (FIG. 3), noise control system 400 (FIG. 4), noise control system 600 (FIG. 6), an ANC system, e.g., system 1100 (FIG. 6), a controller, e.g., controller component 314 (FIG. 3), controller component 414 (FIG. 4), controller 501 (FIG. 5), and/or controller 1300 (FIG. 9) and/or any other component.

As indicated at block 1800, the method may include determining acoustic noise at a plurality of predefined noise sensing locations, which are defined with respect to a predefined noise-control zone. For example, controller 1102 (FIG. 7) may receive noise inputs 1104 (FIG. 7) corresponding to locations 1105 (FIG. 8) with respect to noise control zone 1110 (FIG. 8). For example, inputs 1104 (FIG. 7) may be determined based on inputs from one or more real and/or virtual noise sensors, e.g., as described above.

As indicated at block 1802, the method may include determining acoustic residual-noise at a plurality of predefined residual-noise sensing locations, which are located within the predefined noise-control zone. For example, controller 1102 (FIG. 7) may receive residual noise inputs 1106 (FIG. 7) corresponding to locations 1107 (FIG. 8) with respect to noise control zone 1110 (FIG. 8). For example, inputs 1106 (FIG. 7) may be determined based on inputs from one or more real and/or virtual noise sensors, e.g., as described above.

As indicated at block 1804, the method may include determining a noise control pattern to control the acoustic noise within the noise-control zone, based on the acoustic noise at the plurality of predefined noise sensing locations and the acoustic residual-noise at the plurality of predefined residual-noise sensing locations. For example, controller 1102 (FIG. 7) may determine noise control signal 1109 (FIG. 7), based on noise inputs 1104 (FIG. 7) and residual-noise inputs 1106 (FIG. 7), e.g., as described above.

As indicated at block 1806, the method may include outputting the noise control pattern to at least one acoustic transducer. For example, controller 1102 (FIG. 7) may output signal 1109 (FIG. 7) to control acoustic transducer 1108 (FIG. 7), e.g., as described above.

As indicated at block 1803, the method may include extracting from the plurality of noise inputs a plurality of disjoint reference acoustic patterns, which are statistically independent with respect to at least one predefined attribute. For example, extractor 1306 (FIG. 9) may extract the plurality of disjoint reference acoustic patterns, e.g., as described above. For example, determining the noise control pattern may include determining the noise control pattern based on at least one disjoint reference acoustic pattern of the plurality of disjoint reference acoustic patterns, e.g., as described above.

Figure 13:
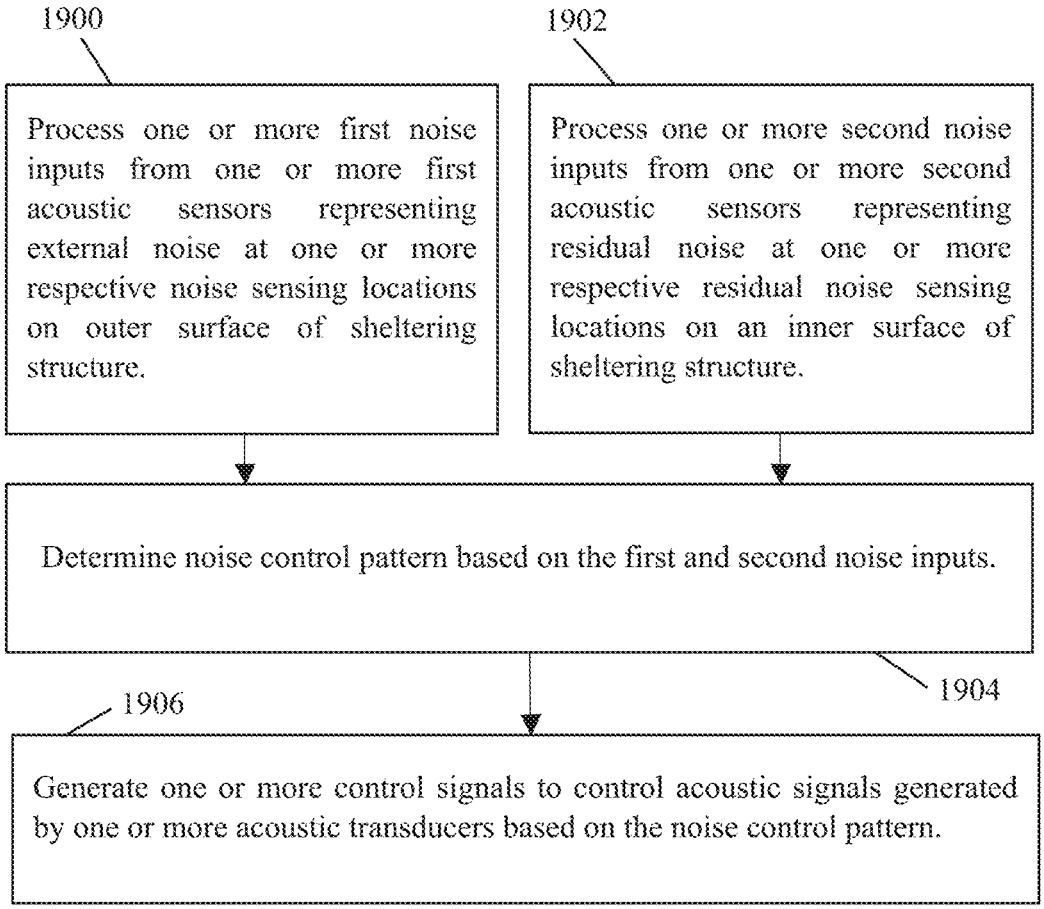
FIG. 13 is a schematic flow-chart illustration of a method of controlling noise within a noise-controlled volume, in accordance with some demonstrative embodiments.

Reference is made to FIG. 13, which is a schematic flow-chart illustration of controlling noise within a noise-controlled volume, in accordance with some demonstrative embodiments. In some demonstrative embodiments, one or more operations of the method of FIG. 13 may be performed by one or more elements of a noise control system, e.g., noise control system 100 (FIG. 1), noise control system 200 (FIG. 2), noise control system 300 (FIG. 3), noise control system 400 (FIG. 4), noise control system 600 (FIG. 6), an ANC system, e.g., system 1100 (FIG. 6), a controller, e.g., controller component 314 (FIG. 3), controller component 414 (FIG. 4), controller 501 (FIG. 5), and/or controller 1300 (FIG. 9) and/or any other component.

As indicated at block 1900, the method may include processing one or more first noise inputs from one or more first acoustic sensors, the one or more first noise inputs representing external noise sensed at one or more respective noise sensing locations on an outer surface of a sheltering structure, For example, control component may 314 (FIG. 3) may be configured to process one or more first noise inputs 395 (FIG. 3) from one or more first acoustic sensors 304 (FIG. 3), the one or more first noise inputs representing external noise sensed at one or more respective noise sensing locations on an outer surface 302 (FIG. 3) of sheltering structure 391 (FIG. 1), e.g., as described above.

As indicated at block 1902, the method may include processing one or more second noise inputs from one or more second acoustic sensors, the one or more second noise inputs representing residual noise at one or more respective residual noise sensing locations on an inner surface of the sheltering structure. For example, control component may 314 (FIG. 3) may be configured to process one or more second noise inputs 397 (FIG. 3) from one or more second acoustic sensors 310 (FIG. 3), the one or more second noise inputs representing residual noise at one or more respective residual noise sensing locations on the inner surface of the sheltering structure 391 (FIG. 3), e.g., as described above.

As indicated at block 1904, the method may include determining a noise control pattern based at least on the one or more first noise inputs and the one or more second noise inputs. For example, controller component 314 (FIG. 3) may be configured to determine the noise control pattern based at least on inputs 295 and 397 (FIG. 3), e.g., as described above.

As indicated at block 1906, the method may include generating one or more control signals to control acoustic signals generated by one or more acoustic transducers based on the noise control pattern. For example, controller component 314 (FIG. 3) may be configured to generate one or more control signals 399 (FIG. 3) to control acoustic signals generated by one or more acoustic transducers 306 (FIG. 3) based on the noise control pattern, e.g., as described above.

Figure 14:
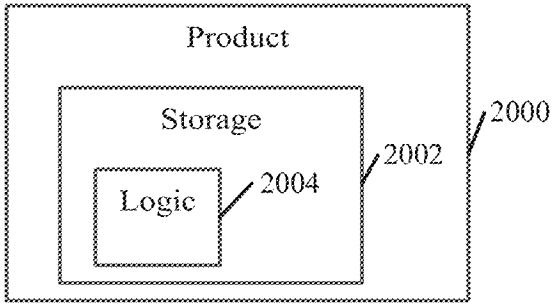
FIG. 14 is a schematic illustration of a product of manufacture, in accordance with some demonstrative embodiments.

Reference is made to FIG. 14, which schematically illustrates a product of manufacture 2000, in accordance with some demonstrative embodiments. Product 2000 may include one or more tangible computer-readable non-transitory storage media 2002, which may include computer-executable instructions, e.g., implemented by logic 2004, operable to, when executed by at least one computer processor, enable the at least one computer processor to implement one or more operations at a noise control system, for example, noise control system 100 (FIG. 1), noise control system 200 (FIG. 2), noise control system 300 (FIG. 3), noise control system 400 (FIG. 4), noise control system 600 (FIG. 6), an ANC system, e.g., system 1100 (FIG. 6), a controller, e.g., controller component 314 (FIG. 3), controller component 414 (FIG. 4), controller 501 (FIG. 5), and/or controller 1300 (FIG. 9) and/or to perform, trigger and/or implement one or more operations and/or functionalities described above with reference to FIGS. 1, 2, 3, 4, 5, 6, 7, 8, 9, 10, 11, 12 and/or 13, and/or one or more operations and/or functionalities described herein. The phrase "non-transitory machine-readable medium" is directed to include all computer-readable media, with the sole exception being a transitory propagating signal.

In some demonstrative embodiments, product 2000 and/or machine-readable storage medium 2002 may include one or more types of computer-readable storage media capable of storing data, including volatile memory, non-volatile memory, removable or non-removable memory, erasable or non-erasable memory, writeable or re-writeable memory, and the like. For example, machine-readable storage medium 2002 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), Compact Disk ROM (CD-ROM), Compact Disk Recordable (CD-R), Compact Disk Rewriteable (CD-RW), flash memory (e.g., NOR or NAND flash memory), content addressable memory (CAM), polymer memory, phase-change memory, ferroelectric memory, silicon-oxide-nitride-oxide-silicon (SONOS) memory, a disk, a floppy disk, a hard drive, an optical disk, a magnetic disk, a card, a magnetic card, an optical card, a tape, a cassette, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative embodiments, logic 2004 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative embodiments, logic 2004 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, such as C, C++, Java, BASIC, Matlab, Pascal, Visual BASIC, assembly language, machine code, and the like.

EXAMPLES

The following examples pertain to further embodiments.

Example 1 includes a noise control system configured to control acoustic noise within a noise-controlled volume, the noise control system comprising a sheltering structure having an inner surface and an outer surface, the inner surface partially surrounding the noise-controlled volume; one or more first acoustic sensors to sense external noise at one or more respective noise sensing locations on the outer surface; one or more second acoustic sensors to sense residual noise at one or more respective residual noise sensing locations on the inner surface; one or more acoustic transducers; and a controller component configured to determine a noise control pattern based at least on one or more first noise inputs from the one or more first acoustic sensors and one or more second noise inputs from the one or more second acoustic sensors, the controller component configured to generate one or more control signals to control acoustic signals generated by the one or more acoustic transducers based on the noise control pattern.

Example 2 includes the subject matter of Example 1, and optionally, wherein the controller component is to determine the noise control pattern configured to reduce or eliminate a noise pattern in the noise-controlled volume resulting from the external noise.

Example 3 includes the subject matter of Example 1 or 2, and optionally, wherein the controller component is configured to determine the noise control pattern based on input audio to be heard within the noise-controlled volume.

Example 4 includes the subject matter of Example 3, and optionally, wherein the controller component is configured to determine a noise reduction pattern based on the one or more first noise inputs and the one or more second noise inputs, and to determine the noise control pattern based on a combination of the noise reduction pattern and an input audio pattern corresponding to the input audio.

Example 5 includes the subject matter of Example 3 or 4, and optionally, wherein the controller component comprises an echo-processing component configured to determine a processed audio pattern by applying to the input audio pattern a function, which is based on one or more paths between the one or more second acoustic sensors and the one or more acoustic transducers, the controller component configured to determine the noise reduction pattern based on a difference between the one or more second noise inputs and the processed audio pattern.

Example 6 includes the subject matter of Example 5, and optionally, wherein the controller component comprises another echo-processing component configured to determine a processed noise reduction pattern by applying to the noise reduction pattern another function, which is based on one or more paths between the one or more first acoustic sensors and the one or more acoustic transducers, the controller component configured to determine the noise reduction pattern based on a difference between the one or more first noise inputs and the processed noise reduction pattern.

Example 7 includes the subject matter of any one of Examples 3-6, and optionally, comprising a communication interface to receive the input audio from a user device.

Example 8 includes the subject matter of any one of Examples 1-7, and optionally, wherein the controller component is configured to control at least one acoustic transducer of the one or more acoustic transducers to generate audio signals based on input audio to be heard within the noise-controlled volume.

Example 9 includes the subject matter of Example 8, and optionally, comprising a communication interface to receive the input audio from a user device.

Example 10 includes the subject matter of any one of Examples 1-9, and optionally, wherein the one or more first acoustic sensors comprise a plurality of first acoustic sensors distributed to sense the external noise at a respective plurality of different locations on the outer surface.

Example 11 includes the subject matter of any one of Examples 1-10, and optionally, wherein the one or more second acoustic sensors comprise a plurality of second acoustic sensors distributed to sense the residual noise at a respective plurality of different locations on the inner surface.

Example 12 includes the subject matter of any one of Examples 1-11, and optionally, wherein the controller component is configured to extract from the one or more first noise inputs a plurality of disjoint reference acoustic patterns, which are statistically independent, and wherein the controller component is configured to determine the noise control pattern based on at least one disjoint reference acoustic pattern of the plurality of disjoint reference acoustic patterns.

Example 13 includes the subject matter of any one of Examples 1-12, and optionally, wherein the one or more first acoustic sensors are embedded within the outer surface of the sheltering structure.

Example 14 includes the subject matter of any one of Examples 1-13, and optionally, wherein the one or more second acoustic sensors are embedded within the inner surface of the sheltering structure.

Example 15 includes the subject matter of any one of Examples 1-14, and optionally, wherein the sheltering structure comprises at least one passive noise reduction component to absorb at least a predefined spectrum of the external noise.

Example 16 includes the subject matter of Example 15, and optionally, wherein the one or more first acoustic sensors are on a first side of the passive noise reduction component, and the one or more second acoustic sensors are on a second side, opposite to the first side, of the passive noise reduction component.

Example 17 includes the subject matter of any one of Examples 1-16, and optionally, wherein the sheltering structure comprises at least one opening configured to allow insertion of at least a head of at least one user into the noise-controlled volume.

Example 18 includes the subject matter of any one of Examples 1-17, and optionally, wherein the sheltering structure comprises a box-like structure partially surrounding the noise-controlled volume.

Example 19 includes the subject matter of any one of Examples 1-17, and optionally, wherein the sheltering structure comprises a shell-like structure partially surrounding the noise-controlled volume.

Example 20 includes a controller comprising a memory and a processor, the processor configured to control a noise control system configured to control acoustic noise within a noise-controlled volume, the processor configured to process one or more first noise inputs from one or more first acoustic sensors, the one or more first noise inputs representing external noise sensed at one or more respective noise sensing locations on an outer surface of a sheltering structure; process one or more second noise inputs from one or more second acoustic sensors, the one or more second noise inputs representing residual noise at one or more respective residual noise sensing locations on an inner surface of the sheltering structure; determine a noise control pattern based at least on the one or more first noise inputs and the one or more second noise inputs; and generate one or more control signals to control acoustic signals generated by one or more acoustic transducers based on the noise control pattern.

Example 21 includes the subject matter of Example 20, and optionally, wherein the processor is configured to determine the noise control pattern configured to reduce or eliminate a noise pattern in the noise-controlled volume resulting from the external noise.

Example 22 includes the subject matter of Example 20 or 21, and optionally, wherein the processor is configured to determine the noise control pattern based on input audio to be heard within the noise-controlled volume.

Example 23 includes the subject matter of Example 22, and optionally, wherein the processor is configured to determine a noise reduction pattern based on the one or more first noise inputs and the one or more second noise inputs, and to determine the noise control pattern based on a combination of the noise reduction pattern and an input audio pattern corresponding to the input audio.

Example 24 includes the subject matter of Example 22 or 23, and optionally, wherein the processor is configured to determine a processed audio pattern by applying to the input audio pattern a function, which is based on one or more paths between the one or more second acoustic sensors and the one or more acoustic transducers, the processor configured to determine the noise reduction pattern based on a difference between the one or more second noise inputs and the processed audio pattern.

Example 25 includes the subject matter of Example 24, and optionally, wherein the processor is configured to determine a processed noise reduction pattern by applying to the noise reduction pattern another function, which is based on one or more paths between the one or more first acoustic sensors and the one or more acoustic transducers, the processor configured to determine the noise reduction pattern based on a difference between the one or more first noise inputs and the processed noise reduction pattern.

Example 26 includes the subject matter of any one of Examples 20-25, and optionally, wherein the processor is configured to control at least one acoustic transducer of the one or more acoustic transducers to generate audio signals based on input audio to be heard within the noise-controlled volume.

Example 27 includes the subject matter of any one of Examples 20-26, and optionally, wherein the one or more first acoustic sensors comprise a plurality of first acoustic sensors distributed to sense the external noise at a respective plurality of different locations on the outer surface.

Example 28 includes the subject matter of any one of Examples 20-27, and optionally, wherein the one or more second acoustic sensors comprise a plurality of second acoustic sensors distributed to sense the residual noise at a respective plurality of different locations on the inner surface.

Example 29 includes the subject matter of any one of Examples 20-28, and optionally, wherein the processor is configured to extract from the one or more first noise inputs a plurality of disjoint reference acoustic patterns, which are statistically independent, and wherein the processor is configured to determine the noise control pattern based on at least one disjoint reference acoustic pattern of the plurality of disjoint reference acoustic patterns.

Example 30 includes a product comprising one or more tangible computer-readable storage media comprising computer-executable instructions operable to, when executed by at least one computer processor, enable the at least one computer processor to implement one or more operations at a noise control system configured to control acoustic noise within a noise-controlled volume, the operations comprising processing one or more first noise inputs from one or more first acoustic sensors, the one or more first noise inputs representing external noise sensed at one or more respective noise sensing locations on an outer surface of a sheltering structure; processing one or more second noise inputs from one or more second acoustic sensors, the one or more second noise inputs representing residual noise at one or more respective residual noise sensing locations on an inner surface of the sheltering structure; determining a noise control pattern based at least on the one or more first noise inputs and the one or more second noise inputs; and generating one or more control signals to control acoustic signals generated by one or more acoustic transducers based on the noise control pattern.

Example 31 includes the subject matter of Example 30, and optionally, wherein the operations comprise determining the noise control pattern configured to reduce or eliminate a noise pattern in the noise-controlled volume resulting from the external noise.

Example 32 includes the subject matter of Example 30 or 31, and optionally, wherein the operations comprise determining the noise control pattern based on input audio to be heard within the noise-controlled volume.

Example 33 includes the subject matter of Example 32, and optionally, wherein the operations comprise determining a noise reduction pattern based on the one or more first noise inputs and the one or more second noise inputs, and determining the noise control pattern based on a combination of the noise reduction pattern and an input audio pattern corresponding to the input audio.

Example 34 includes the subject matter of Example 32 or 33, and optionally, wherein the operations comprise determining a processed audio pattern by applying to the input audio pattern a function, which is based on one or more paths between the one or more second acoustic sensors and the one or more acoustic transducers, and determining the noise reduction pattern based on a difference between the one or more second noise inputs and the processed audio pattern.

Example 35 includes the subject matter of Example 34, and optionally, wherein the operations comprise determining a processed noise reduction pattern by applying to the noise reduction pattern another function, which is based on one or more paths between the one or more first acoustic sensors and the one or more acoustic transducers, and determining the noise reduction pattern based on a difference between the one or more first noise inputs and the processed noise reduction pattern.

Example 36 includes the subject matter of any one of Examples 30-35, and optionally, wherein the operations comprise controlling at least one acoustic transducer of the one or more acoustic transducers to generate audio signals based on input audio to be heard within the noise-controlled volume.

Example 37 includes the subject matter of any one of Examples 30-36, and optionally, wherein the one or more first acoustic sensors comprise a plurality of first acoustic sensors distributed to sense the external noise at a respective plurality of different locations on the outer surface.

Example 38 includes the subject matter of any one of Examples 30-37, and optionally, wherein the one or more second acoustic sensors comprise a plurality of second acoustic sensors distributed to sense the residual noise at a respective plurality of different locations on the inner surface.

Example 39 includes the subject matter of any one of Examples 30-38, and optionally, wherein the operations comprise extracting from the one or more first noise inputs a plurality of disjoint reference acoustic patterns, which are statistically independent, and determining the noise control pattern based on at least one disjoint reference acoustic pattern of the plurality of disjoint reference acoustic patterns.

Functions, operations, components and/or features described herein with reference to one or more embodiments, may be combined with, or may be utilized in combination with, one or more other functions, operations, components and/or features described herein with reference to one or more other embodiments, or vice versa.

While certain features have been illustrated and described herein, many modifications, substitutions, changes, and equivalents may occur to those skilled in the art. It is, therefore, to be understood that the appended claims are intended to cover all such modifications and changes as fall within the true spirit of the disclosure.

What is claimed is:

1. A noise control system configured to control acoustic noise within a noise-controlled volume, the noise control system comprising:

a sheltering structure having an inner surface and an outer surface, the inner surface partially surrounding the noise-controlled volume;

one or more first acoustic sensors to sense external noise at one or more respective noise sensing locations on said outer surface;

one or more second acoustic sensors to sense residual noise at one or more respective residual noise sensing locations on said inner surface;

one or more acoustic transducers; and a controller component configured to determine a noise control pattern based at least on one or more first noise inputs from the one or more first acoustic sensors and one or more second noise inputs from the one or more second acoustic sensors, the controller component configured to generate one or more control signals to control acoustic signals generated by said one or more acoustic transducers based on the noise control pattern, said controller component configured to extract from said one or more first noise inputs a plurality of disjoint reference acoustic patterns, which are statistically independent, said controller component is configured to select at least one disjoint reference acoustic pattern from said plurality of disjoint reference acoustic patterns based on one or more predefined acoustic pattern attributes of at least one predefined noise pattern to be controlled within said noise-controlled volume, the controller component configured to determine said noise control pattern based on the at least one disjoint reference acoustic pattern selected from said plurality of disjoint reference acoustic patterns.

2. The noise control system of claim 1, wherein the controller component is to determine the noise control pattern configured to reduce or eliminate a noise pattern in the noise-controlled volume resulting from said external noise.

3. The noise control system of claim 1, wherein the controller component is configured to determine the noise control pattern based on input audio to be heard within the noise-controlled volume.

4. The noise control system of claim 3, wherein the controller component is configured to determine a noise reduction pattern based on the one or more first noise inputs and the one or more second noise inputs, and to determine the noise control pattern based on a combination of the noise reduction pattern and an input audio pattern corresponding to the input audio.

5. The noise control system of claim 4, wherein the controller component comprises an echo-processing component configured to determine a processed audio pattern by applying to the input audio pattern a function, which is based on one or more paths between the one or more second acoustic sensors and the one or more acoustic transducers, the controller component configured to determine the noise reduction pattern based on a difference between the one or more second noise inputs and the processed audio pattern.

6. The noise control system of claim 5, wherein the controller component comprises another echo-processing component configured to determine a processed noise reduction pattern by applying to the noise reduction pattern another function, which is based on one or more paths between the one or more first acoustic sensors and the one or more acoustic transducers, the controller component configured to determine the noise reduction pattern based on a difference between the one or more first noise inputs and the processed noise reduction pattern.

7. The noise control system of claim 3 comprising a communication interface to receive the input audio from a user device.

8. The noise control system of claim 1, wherein the controller component is configured to control at least one acoustic transducer of the one or more acoustic transducers to generate audio signals based on input audio to be heard within the noise-controlled volume.

9. The noise control system of claim 8 comprising a communication interface to receive the input audio from a user device.

10. The noise control system of claim 1, wherein the one or more first acoustic sensors comprise a plurality of first acoustic sensors distributed to sense the external noise at a respective plurality of different locations on the outer surface.

11. The noise control system of claim 1, wherein the one or more second acoustic sensors comprise a plurality of second acoustic sensors distributed to sense the residual noise at a respective plurality of different locations on the inner surface.

12. The noise control system of claim 1, wherein the one or more first acoustic sensors are embedded within the outer surface of the sheltering structure.

13. The noise control system of claim 1, wherein the one or more second acoustic sensors are embedded within the inner surface of the sheltering structure.

14. The noise control system of claim 1, wherein the sheltering structure comprises at least one passive noise reduction component to absorb at least a predefined spectrum of the external noise.

15. The noise control system of claim 14, wherein the one or more first acoustic sensors are on a first side of the passive noise reduction component, and the one or more second acoustic sensors are on a second side, opposite to the first side, of the passive noise reduction component.

16. The noise control system of claim 1, wherein the sheltering structure comprises at least one opening configured to allow insertion of at least a head of at least one user into the noise-controlled volume.

17. The noise control system of claim 1, wherein said sheltering structure comprises a box structure partially surrounding the noise-controlled volume.

18. The noise control system of claim 1, wherein said sheltering structure comprises a shell structure partially surrounding the noise-controlled volume.

19. A controller comprising a memory and a processor, the processor configured to control a noise control system configured to control acoustic noise within a noise-controlled volume, the processor configured to:

process one or more first noise inputs from one or more first acoustic sensors, the one or more first noise inputs representing external noise sensed at one or more respective noise sensing locations on an outer surface of a sheltering structure;

process one or more second noise inputs from one or more second acoustic sensors, the one or more second noise inputs representing residual noise at one or more respective residual noise sensing locations on an inner surface of the sheltering structure;

determine a noise control pattern based at least on the one or more first noise inputs and the one or more second noise inputs, wherein determining the noise control pattern comprises extracting from said one or more first noise inputs a plurality of disjoint reference acoustic patterns, which are statistically independent, selecting at least one disjoint reference acoustic pattern from said plurality of disjoint reference acoustic patterns based on one or more predefined acoustic pattern attributes of at least one predefined noise pattern to be controlled within said noise-controlled volume, and determining said noise control pattern based on the at least one disjoint reference acoustic pattern selected from said plurality of disjoint reference acoustic patterns; and generate one or more control signals to control acoustic signals generated by one or more acoustic transducers based on the noise control pattern.

20. The controller of claim 19, wherein the processor is configured to determine the noise control pattern based on input audio to be heard within the noise-controlled volume.

21. The controller of claim 20, wherein the processor is configured to determine a noise reduction pattern based on the one or more first noise inputs and the one or more second noise inputs, and to determine the noise control pattern based on a combination of the noise reduction pattern and an input audio pattern corresponding to the input audio.

22. The controller of claim 21, wherein the processor is configured to determine a processed audio pattern by applying to the input audio pattern a function, which is based on one or more paths between the one or more second acoustic sensors and the one or more acoustic transducers, the processor configured to determine the noise reduction pattern based on a difference between the one or more second noise inputs and the processed audio pattern.

23. The controller of claim 22, wherein the processor is configured to determine a processed noise reduction pattern by applying to the noise reduction pattern another function, which is based on one or more paths between the one or more first acoustic sensors and the one or more acoustic transducers, the processor configured to determine the noise reduction pattern based on a difference between the one or more first noise inputs and the processed noise reduction pattern.

24. A product comprising one or more tangible computer-readable non-transitory storage media comprising computer-executable instructions operable to, when executed by at least one processor, enable the at least one processor to cause a noise control system to control acoustic noise within a noise-controlled volume, the instructions, when executed by the at least one processor, to cause the noise control system to:

process one or more first noise inputs from one or more first acoustic sensors, the one or more first noise inputs representing external noise sensed at one or more respective noise sensing locations on an outer surface of a sheltering structure;

process one or more second noise inputs from one or more second acoustic sensors, the one or more second noise inputs representing residual noise at one or more respective residual noise sensing locations on an inner surface of the sheltering structure;

determine a noise control pattern based at least on the one or more first noise inputs and the one or more second noise inputs, wherein determining the noise control pattern comprises extracting from said one or more first noise inputs a plurality of disjoint reference acoustic patterns, which are statistically independent, selecting at least one disjoint reference acoustic pattern from said plurality of disjoint reference acoustic patterns based on one or more predefined acoustic pattern attributes of at least one predefined noise pattern to be controlled within said noise-controlled volume, and determining said noise control pattern based on the at least one disjoint reference acoustic pattern selected from said plurality of disjoint reference acoustic patterns; and generate one or more control signals to control acoustic signals generated by one or more acoustic transducers based on the noise control pattern.

25. The product of claim 24, wherein the instructions, when executed by the at least one processor, cause the noise control system to determine the noise control pattern configured to reduce or eliminate a noise pattern in the noise-controlled volume resulting from said external noise.

26. The product of claim 24, wherein the instructions, when executed by the at least one processor, cause the noise control system to control at least one acoustic transducer of the one or more acoustic transducers to generate audio signals based on input audio to be heard within the noise-controlled volume.

* * * * *